US009932137B2

(12) United States Patent
Lancaster, III et al.

(10) Patent No.: US 9,932,137 B2
(45) **Date of Patent: *Apr. 3, 2018**

(54) CORNER GEOMETRY-BASED WRAPPING

(71) Applicant: Lantech.com, LLC, Louisville, KY (US)

(72) Inventors: Patrick R. Lancaster, III, Louisville, KY (US); Michael P. Mitchell, Louisville, KY (US); Jeremy D. McCray, Waddy, KY (US); Richard L. Johnson, LaGrange, KY (US)

(73) Assignee: Lantech.com, LLC, Louisville, KY (US)

( * ) Notice: Subject to any disclaimer, the term of this patent is extended or adjusted under 35 U.S.C. 154(b) by 501 days.

This patent is subject to a terminal disclaimer.

(21) Appl. No.: 14/062,931

(22) Filed: Oct. 25, 2013

(65) Prior Publication Data

US 2014/0116008 A1 May 1, 2014

Related U.S. Application Data

(60) Provisional application No. 61/718,429, filed on Oct. 25, 2012, provisional application No. 61/718,433, filed on Oct. 25, 2012.

(51) Int. Cl.
*B65B 13/02* (2006.01)
*B65B 57/04* (2006.01)
(Continued)

(52) U.S. Cl.
CPC ..... *B65B 57/04* (2013.01); *B65B 11/025* (2013.01); *B65B 11/045* (2013.01)

(58) Field of Classification Search
CPC ..... B65B 11/008; B65B 11/025; B65B 11/04; B65B 11/045; B65B 57/02; B65B 57/04; B65B 57/12
(Continued)

(56) References Cited

U.S. PATENT DOCUMENTS 2,227,398 A 12/1940 Mohl
2,904,196 A 9/1959 Teixeira
(Continued)

FOREIGN PATENT DOCUMENTS

DE 3140972 6/1982
DE 3119038 12/1982
(Continued)

OTHER PUBLICATIONS

"The Technology Behind a 'No-Tear', 'No-Rip' Film Carriage, and How to Explain it to your Customers," Jan. 21, 2010, downloaded from http://wulftecstretchwrapper.blogspt.com/2010_01_01archive.html on Jan. 7, 2011; 4 pages.
(Continued)

*Primary Examiner* — Sameh Tawfik
(74) *Attorney, Agent, or Firm* — Middleton Reutlinger

(57) ABSTRACT

A wrapping apparatus and method utilize a corner geometry-based wrap control that controls the rate at which packaging material is dispensed at least in part based on the geometrical relationship between one or more corners of a load and a packaging material dispenser.

44 Claims, 21 Drawing Sheets

(51) Int. Cl.
*B65B 11/04* (2006.01)
*B65B 11/02* (2006.01)

(58) Field of Classification Search
USPC ... 53/64, 503, 504, 399, 441, 556, 582, 587, 53/588, 465, 210, 211
See application file for complete search history.

(56) References Cited

U.S. PATENT DOCUMENTS 3,029,571 A 4/1962 Douthit
3,707,658 A 12/1972 Hilsenbeck
3,815,313 A 6/1974 Heisler
3,910,005 A 10/1975 Thimon et al.
4,152,879 A 5/1979 Shulman
4,216,640 A 8/1980 Kaufman
4,235,062 A 11/1980 Lancaster, III et al.
4,271,657 A 6/1981 Lancaster, III et al.
4,300,326 A 11/1981 Stackhouse
4,387,548 A 6/1983 Lancaster et al.
4,395,255 A 7/1983 Branecky et al.
4,418,510 A 12/1983 Lancaster, III et al.
4,429,514 A 2/1984 Lancaster, III et al.
4,432,185 A 2/1984 Geisinger
4,458,467 A 7/1984 Shulman et al.
4,497,159 A 2/1985 Lancaster, III
4,501,105 A 2/1985 Rogers et al.
4,503,658 A 3/1985 Mouser et al.
4,505,092 A 3/1985 Bowers et al.
4,514,955 A 5/1985 Mouser et al.
4,524,568 A 6/1985 Lancaster et al.
4,590,746 A 5/1986 Humphrey
4,628,667 A 12/1986 Humphrey et al.
4,676,048 A 6/1987 Lancaster et al.
4,693,049 A * 9/1987 Humphrey ..... B65B 11/045 53/556
4,712,354 A 12/1987 Lancaster et al.
4,716,709 A 1/1988 Lamb et al.
4,736,567 A 4/1988 Pienta
4,754,594 A * 7/1988 Lancaster ..... B65B 11/045 53/399
4,761,934 A 8/1988 Lancaster
4,807,427 A 2/1989 Casteel et al.
4,840,006 A 6/1989 Humphrey
4,845,920 A 7/1989 Lancaster
4,855,924 A 8/1989 Strosser
4,862,678 A 9/1989 Humphrey
4,866,909 A * 9/1989 Lancaster, III ..... B65B 11/008 53/399
4,905,451 A 3/1990 Jaconelli et al.
4,953,336 A * 9/1990 Lancaster, III ..... B65B 11/008 53/176
4,991,381 A 2/1991 Simons
5,027,579 A 7/1991 Keip
5,040,356 A 8/1991 Thimon
5,040,359 A 8/1991 Thimon
5,054,263 A 10/1991 Maki-Rahkola et al.
5,054,987 A 10/1991 Thornton
5,077,956 A 1/1992 Thimon
5,081,824 A 1/1992 Thimon et al.
5,107,657 A 4/1992 Diehl et al.
5,123,230 A 6/1992 Upmann
5,138,817 A 8/1992 Mowry et al.
5,163,264 A 11/1992 Hannen
5,186,981 A 2/1993 Shellhamer et al.
5,195,296 A 3/1993 Matsumoto
5,195,297 A 3/1993 Lancaster et al.
5,195,301 A 3/1993 Martin-Cocher et al.
5,203,136 A 4/1993 Thimon et al.
5,203,139 A 4/1993 Salsburg et al.
5,216,871 A 6/1993 Hannen
5,240,198 A 8/1993 Dorfel
5,301,493 A 4/1994 Chen
5,311,725 A 5/1994 Martin et al.
5,315,809 A 5/1994 Gordon et al.
5,369,416 A 11/1994 Haverty et al.
5,414,979 A 5/1995 Moore et al.
5,447,008 A 9/1995 Martin-Cocher
5,450,711 A 9/1995 Martin-Cocher
5,463,842 A 11/1995 Lancaster
5,524,413 A 6/1996 Fukuda
5,546,730 A 8/1996 Newell et al.
5,572,855 A 11/1996 Reigrut et al.
5,581,979 A 12/1996 Scherer
5,595,042 A 1/1997 Cappi et al.
5,634,321 A 6/1997 Martin-Cocher et al.
5,653,093 A 8/1997 Delledonne
5,671,593 A 9/1997 Ginestra et al.
5,765,344 A 6/1998 Mandeville et al.
5,768,862 A 6/1998 Mauro
5,797,246 A * 8/1998 Martin-Cocher ..... B29C 55/06 264/288.4
5,799,471 A 9/1998 Chen
5,836,140 A 11/1998 Lancaster, III
5,875,617 A 3/1999 Scherer
5,884,453 A 3/1999 Ramsey et al.
5,953,888 A 9/1999 Martin-Cocher et al.
6,082,081 A 7/2000 Mucha
6,185,900 B1 * 2/2001 Martin ..... B65B 11/045 53/118
6,195,968 B1 3/2001 Marois et al.
6,253,532 B1 7/2001 Orpen
6,293,074 B1 9/2001 Lancaster, III et al.
6,314,333 B1 11/2001 Rajala et al.
6,338,480 B1 * 1/2002 Endo ..... B65H 3/5223 271/104
6,360,512 B1 3/2002 Marois et al.
6,370,839 B1 4/2002 Nakagawa et al.
6,453,643 B1 9/2002 Buscherini et al.
6,516,591 B1 2/2003 Lancaster, III et al.
6,684,612 B2 2/2004 Trottet
6,698,161 B1 3/2004 Rossi
6,748,718 B2 6/2004 Lancaster, III et al.
6,826,893 B2 12/2004 Cere'
6,848,240 B2 2/2005 Frey
6,851,252 B2 2/2005 Maki-Rahkola et al.
6,918,229 B2 7/2005 Lancaster, III et al.
7,040,071 B2 5/2006 Heikaus
7,114,308 B2 10/2006 Cox
7,386,968 B2 6/2008 Sperry et al.
7,490,823 B2 2/2009 Oishi et al.
7,540,128 B2 6/2009 Lancaster, III et al.
7,568,327 B2 8/2009 Lancaster, III et al.
7,707,801 B2 5/2010 Lancaster, III
7,707,901 B2 5/2010 Lancaster et al.
7,779,607 B2 8/2010 Lancaster, III et al.
8,001,745 B2 8/2011 Carter et al.
8,037,660 B2 10/2011 Lancaster, III et al.
8,074,431 B1 * 12/2011 Pierson ..... B65G 47/086 414/791.6
8,276,346 B2 10/2012 Lancaster, III et al.
8,276,354 B2 10/2012 Lancaster, III et al.
8,739,502 B2 6/2014 Lancaster, III et al.
8,915,460 B2 * 12/2014 Busch ..... B65H 23/063 242/418.1
2001/0015057 A1 8/2001 Suolahti
2003/0089081 A1 5/2003 Platon
2003/0110737 A1 * 6/2003 Lancaster, III ..... B65B 11/008 53/441
2003/0145563 A1 8/2003 Cere'
2003/0200731 A1 10/2003 Maki-Rahkola et al.
2003/0200732 A1 10/2003 Maki-Rahkola et al.
2004/0031238 A1 * 2/2004 Cox ..... B65B 11/045 53/399
2004/0040477 A1 3/2004 Neumann
2005/0044812 A1 3/2005 Lancaster et al.
2005/0115202 A1 6/2005 Mertz et al.
2006/0028969 A1 2/2006 Kondo et al.
2006/0213155 A1 9/2006 Forni et al.
2006/0248858 A1 11/2006 Lancaster
2006/0254214 A1 11/2006 Cox et al.
2006/0254225 A1 11/2006 Lancaster et al.
2006/0264214 A1 11/2006 Cox et al.
2006/0289691 A1 12/2006 Forni

(56) References Cited

U.S. PATENT DOCUMENTS

| | | | | |
|---|---|---|---|---|
| 2007/0204564 | A1 | 9/2007 | Lancaster et al. | |
| 2007/0204565 | A1 | 9/2007 | Lancaster et al. | |
| 2007/0209324 | A1 | 9/2007 | Lancaster et al. | |
| 2008/0216449 | A1 | 9/2008 | Zimmerli | |
| 2008/0229714 | A1 | 9/2008 | Zitella et al. | |
| 2008/0295614 | A1 | 12/2008 | Lancaster, III et al. | |
| 2009/0178374 | A1* | 7/2009 | Lancaster, III ..... | B65B 11/025 53/441 |
| 2009/0293425 | A1 | 12/2009 | Carter et al. | |
| 2010/0107653 | A1 | 5/2010 | Paskevich et al. | |
| 2010/0239403 | A1 | 9/2010 | Lancaster, III et al. | |
| 2010/0300049 | A1 | 12/2010 | Schmidt et al. | |
| 2010/0303526 | A1 | 12/2010 | Hayase | |
| 2010/0320305 | A1 | 12/2010 | Lia | |
| 2011/0131927 | A1* | 6/2011 | Lancaster, III ..... | B65B 11/025 53/461 |
| 2011/0146203 | A1 | 6/2011 | Lancaster, III et al. | |
| 2011/0153277 | A1 | 6/2011 | Morath | |
| 2011/0168751 | A1 | 7/2011 | Tsurumi | |
| 2011/0179752 | A1 | 7/2011 | Lancaster, III et al. | |
| 2012/0031053 | A1 | 2/2012 | Lancaster, III et al. | |
| 2012/0102886 | A1 | 5/2012 | Lancaster, III | |
| 2012/0102887 | A1 | 5/2012 | Lancaster, III | |
| 2012/0124944 | A1 | 5/2012 | Lancaster, III et al. | |
| 2012/0181368 | A1 | 7/2012 | Ekola | |
| 2013/0076753 | A1 | 3/2013 | Lancaster, III et al. | |
| 2014/0116006 | A1 | 5/2014 | Lancaster, III et al. | |
| 2014/0116007 | A1 | 5/2014 | Lancaster, III et al. | |
| 2014/0116008 | A1 | 5/2014 | Lancaster, III et al. | |
| 2015/0353220 | A1 | 12/2015 | Lancaster, III | |
| 2016/0096646 | A1 | 4/2016 | Lancaster, III | |
| 2017/0088301 | A1 | 3/2017 | Riemenschneider | |

FOREIGN PATENT DOCUMENTS

| | | | |
|---|---|---|---|
| DE | 3634924 | A1 | 4/1988 |
| DE | 3901704 | | 8/1990 |
| DE | 4234604 | A1 | 4/1994 |
| DE | 19509649 | | 9/1996 |
| EP | 0096635 | A2 | 12/1983 |
| EP | 0144266 | | 6/1985 |
| EP | 0246659 | | 11/1987 |
| EP | 0466980 | A1 | 1/1992 |
| EP | 0653352 | | 5/1995 |
| EP | 0671324 | | 9/1995 |
| EP | 0811554 | A1 | 12/1997 |
| EP | 0842850 | A2 | 5/1998 |
| EP | 1125841 | A1 | 8/2001 |
| EP | 1213223 | A1 | 6/2002 |
| EP | 1489004 | A2 | 12/2004 |
| EP | 1705119 | A1 | 9/2006 |
| EP | 1717149 | A1 | 11/2006 |
| EP | 1736426 | A2 | 12/2006 |
| EP | 1736426 | A3 | 10/2007 |
| GB | 1546523 | | 5/1979 |
| GB | 2059906 | | 4/1981 |
| GB | 2059906 | A † | 4/1981 |
| GB | 2107668 | A | 5/1983 |
| JP | 57166252 | | 10/1982 |
| JP | 63191707 | | 8/1988 |
| JP | 0385209 | | 4/1991 |
| JP | 06239311 | | 8/1994 |
| JP | 085448 | | 1/1996 |
| JP | 09254913 | | 9/1997 |
| JP | 11165705 | | 6/1999 |
| JP | 2001048111 | | 2/2001 |
| JP | 2001072012 | A | 3/2001 |
| JP | 2002211503 | | 7/2002 |
| JP | 2004161344 | A | 6/2004 |
| JP | 3634993 | | 1/2005 |
| JP | 4350940 | | 10/2009 |
| WO | 9107341 | | 5/1991 |
| WO | 9420367 | A1 | 9/1994 |
| WO | 9700202 | A1 | 1/1997 |
| WO | 9822346 | A1 | 5/1998 |
| WO | 2004069659 | A1 | 8/2004 |
| WO | 2006110596 | A1 | 10/2006 |
| WO | 2007071593 | A1 | 6/2007 |
| WO | 2007/100596 | A2 | 9/2007 |
| WO | 2007100597 | A2 | 9/2007 |
| WO | 2008007189 | A2 | 1/2008 |
| WO | 2008129432 | A1 | 10/2008 |
| WO | 2012058549 | | 5/2012 |

OTHER PUBLICATIONS

International Search Report for Application No. PCT/US13/066807, Jan. 31, 2014.
Written Opinion of the International Searching Authority for Application No. PCT/US2013/066807, Jan. 31, 2014.
International Search Report for Application No. PCT/US13/066823, Feb. 10, 2014.
Written Opinion of the International Searching Authority for Application No. PCT/US2013/066823, Feb. 10, 2014.
Partial International Search Report for Application No. PCT/US13/066838, Jan. 30, 2014.
International Search Report and Written Opinion of the International Searching Authority for Application No. PCT/US13/066838, Apr. 16, 2014.
U.S. Appl. No. 14/062,929 entitled, "Rotation Angle-Based Wrapping" filed by Patrick R. Lancaster III on Oct. 25, 2013.
U.S. Appl. No. 14/062,930 entitled, "Effective Circumference-Based Wrapping" filed by Patrick R. Lancaster III on Oct. 25, 2013.
http://2012.modexshow.com/press/release.aspx?ref=press&id=1899 Feb. 6, 2012.
http://www.mhpn.com/product/force_anticipation_stretch_technology_for_stretch_wrappers/packaging Nov. 23, 2012.
http://www.wulftec.com/contents/brochures/015f519c-8a1a-4a0b-81d1-727cbdcbf946.pdf Oct. 10, 2012.
http://literature.rockwellautomation.com/idc/groups/literature/documents/ap/oem-ap069_-en-p.pdf Aug. 1, 2011.
http://www.packworld.com/machinery/palletizing/wulftec-international-film-feeding-system-secure-product-containment Sep. 14, 2011.
Final Office Action dated Jun. 1, 2017 in U.S. Appl. No. 14/062,930.
Australian Government IP Australia, Examination Report No. 1 for 2013334172 dated Dec. 13, 2016; 3 pages.
Australian Government IP Australia, Examination Report No. 1 for 2013334151 dated Oct. 5, 2016; 3 pages.
European Patent Office; European Search Report in EP Application No. 13786849.3 dated May 19, 2016; 4 pages.
European Patent Office; European Search Report in EP Application No. 13786851.9 dated May 19, 2016; 4 pages.
European Patent Office; European Search Report in EP Application No. 13788850.9 dated May 19, 2016; 4 pages.
Jallow, Eyamindae Chossan (Examiner), U.S. Patent and Trademark Office, Office issued in related U.S. Appl. No. 14/062,930, dated Dec. 2, 2016, 17 pages.
Fernandes, Crystal A. (Examiner), U.S. Patent and Trademark Office, Office Action issued in related U.S. Appl. No. 14/062,929, dated Jun., 24 2016.
Ernandes, Crystal A. (Examiner), U.S. Patent and Trademark Office, Notice of Allowance issued in related U.S. Appl. No. 14/062,929, dated Dec. 5, 2016.
Bossler, John D., "Manual of Geospatial Science and Technology", CRC Press 2001, pp. 8-15.
Bossier, John D., "Manual of Geospatial Science and Technology", CRC Press 2001, pp. 8-15.
Australian Government IP Australia, Examination Report No. 1 for 2013334151 dated Oct. 5, 2016.
European Patent Office: European Search Report in EP Application No. 13786849.39 dated May 19, 2016.
Non-Final Office Action dated Sep. 13, 2017 in U.S. Appl. No. 14/062,929.
European Patent Office; Communication in Application No. 17185857.4 dated Dec. 15, 2017.

(56) References Cited

OTHER PUBLICATIONS

European European Patent Office; Communication in Application No. 13788850.9 dated Nov. 29, 2017.
U.S. Patent Office; Notice of Allowance in U.S. Appl. No. 14/062,930 dated Nov. 14, 2017.
Australian Patent Office; Notice of Acceptance in Application No. 2013334172 dated Sep. 4, 2017.
Australian Patent Office; Notice of Acceptance in Application No. 2013334172 dated Sep. 4. 2017.
Australian Patent Office, Notice of Acceptance in Application No. 2013334151 dated Sep. 5, 2017.
Australian Patent Office; Examination Report in Application No. 2013334160 dated Jan. 24, 2018.

* cited by examiner
† cited by third party

CORNER GEOMETRY-BASED WRAPPING

CROSS-REFERENCE TO RELATED APPLICATIONS

This application claims the benefit of and priority to U.S. Provisional Application Ser. No. 61/718,429 filed on Oct. 25, 2012 by Patrick R. Lancaster III et al., and entitled "ROTATION ANGLE-BASED WRAPPING," and U.S. Provisional Application Ser. No. 61/718,433 filed on Oct. 25, 2012 by Patrick R. Lancaster III et al., and entitled "EFFECTIVE CIRCUMFERENCE-BASED WRAPPING," which applications are incorporated by reference in their entirety.

FIELD OF THE INVENTION

The invention generally relates to wrapping loads with packaging material through relative rotation of loads and a packaging material dispenser, and in particular, to the control of the rate in which packaging material is dispensed during wrapping.

BACKGROUND OF THE INVENTION

Various packaging techniques have been used to build a load of unit products and subsequently wrap them for transportation, storage, containment and stabilization, protection and waterproofing. One system uses wrapping machines to stretch, dispense, and wrap packaging material around a load. The packaging material may be pre-stretched before it is applied to the load. Wrapping can be performed as an inline, automated packaging technique that dispenses and wraps packaging material in a stretch condition around a load on a pallet to cover and contain the load. Stretch wrapping, whether accomplished by a turntable, rotating arm, vertical rotating ring, or horizontal rotating ring, typically covers the four vertical sides of the load with a stretchable packaging material such as polyethylene packaging material. In each of these arrangements, relative rotation is provided between the load and the packaging material dispenser to wrap packaging material about the sides of the load.

A primary metric used in the shipping industry for gauging overall wrapping effectiveness is containment force, which is generally the cumulative force exerted on the load by the packaging material wrapped around the load. Containment force depends on a number of factors, including the number of layers of packaging material, the thickness, strength and other properties of the packaging material, the amount of pre-stretch applied to the packaging material, and the wrap force applied to the load while wrapping the load. The wrap force, however, is a force that fluctuates as packaging material is dispensed to the load due primarily to the irregular geometry of the load.

In particular, wrappers have historically suffered from packaging material breaks and limitations on the amount of wrap force applied to the load (as determined in part by the amount of pre-stretch used) due to erratic speed changes required to wrap loads. Were all loads perfectly cylindrical in shape and centered precisely at the center of rotation for the relative rotation, the rate at which packaging material would need to be dispensed would be constant throughout the rotation. Typical loads, however, are generally box-shaped, and have a square or rectangular cross-section in the plane of rotation, such that even in the case of square loads, the rate at which packaging material is dispensed varies throughout the rotation. In some instances, loosely wrapped loads result due to the supply of excess packaging material during portions of the wrapping cycle where the demand rate for packaging material by the load is exceeded by the rate at which the packaging material is supplied by the packaging material dispenser. In other instances, when the demand rate for packaging material by the load is greater than the supply rate of the packaging material by the packaging material dispenser, breakage of the packaging material may occur.

When wrapping a typical rectangular load, the demand for packaging material typically decreases as the packaging material approaches contact with a corner of the load and increases after contact with the corner of the load. When wrapping a tall, narrow load or a short load, the variation in the demand rate is typically even greater than in a typical rectangular load. In vertical rotating rings, high speed rotating arms, and turntable apparatuses, the variation is caused by a difference between the length and the width of the load, while in a horizontal rotating ring apparatus, the variation is caused by a difference between the height of the load (distance above the conveyor) and the width of the load. Variations in demand may make it difficult to properly wrap the load, and the problem with variations may be exacerbated when wrapping a load having one or more dimensions that may differ from one or more corresponding dimensions of a preceding load. The problem may also be exacerbated when wrapping a load having one or more dimensions that vary at one or more locations of the load itself. Furthermore, whenever a load is not centered precisely at the center of rotation of the relative rotation, the variation in the demand rate is also typically greater, as the corners and sides of even a perfectly symmetric load will be different distances away from the packaging material dispenser as they rotate past the dispenser.

The amount of force, or pull, that the packaging material exhibits on the load determines in part how tightly and securely the load is wrapped. Conventionally, this wrap force is controlled by controlling the feed or supply rate of the packaging material dispensed by the packaging material dispenser. For example, the wrap force of many conventional stretch wrapping machines is controlled by attempting to alter the supply of packaging material such that a relatively constant packaging material wrap force is maintained. With powered pre-stretching devices, changes in the force or tension of the dispensed packaging material are monitored, e.g., by using feedback mechanisms typically linked to spring loaded dancer bars, electronic load cells, or torque control devices. The changing force or tension of the packaging material caused by rotating a rectangular shaped load is transmitted back through the packaging material to some type of sensing device, which attempts to vary the speed of the motor driven dispenser to minimize the change. The passage of the corner causes the force or tension of the packaging material to increase, and the increase is typically transmitted back to an electronic load cell, spring-loaded dancer interconnected with a sensor, or to a torque control device. As the corner approaches, the force or tension of the packaging material decreases, and the reduction is transmitted back to some device that in turn reduces the packaging material supply to attempt to maintain a relatively constant wrap force or tension.

With the ever faster wrapping rates demanded by the industry, however, rotation speeds have increased significantly to a point where the concept of sensing changes in force and altering supply speed in response often loses effectiveness. The delay of response has been observed to begin to move out of phase with rotation at approximately 20

RPM. Given that a packaging dispenser is required to shift between accelerating and decelerating eight times per revolution in order to accommodate the four corners of the load, at 20 RPM the shift between acceleration and deceleration occurs at a rate of more than every once every half of a second. Given also that the rotating mass of a packaging material roll and rollers in a packaging material dispenser may be 100 pounds or more, maintaining an ideal dispense rate throughout the relative rotation can be a challenge.

Also significant is the need in many applications to minimize acceleration and deceleration times for faster cycles. Initial acceleration must pull against clamped packaging material, which typically cannot stand a high force, and especially the high force of rapid acceleration, which typically cannot be maintained by the feedback mechanisms described above. As a result of these challenges, the use of high speed wrapping has often been limited to relatively lower wrap forces and pre-stretch levels where the loss of control at high speeds does not produce undesirable packaging material breaks.

In addition, due to environmental, cost and weight concerns, an ongoing desire exists to reduce the amount of packaging material used to wrap loads, typically through the use of thinner, and thus relatively weaker packaging materials and/or through the application of fewer layers of packaging material. As such, maintaining adequate containment forces in the presence of such concerns, particularly in high speed applications, can be a challenge.

Therefore, a significant need continues to exist in the art for an improved manner of controlling the rate at which packaging material is dispensed during wrapping of a load, particularly to provide greater wrap force, and ultimately greater containment force to the load.

SUMMARY OF THE INVENTION

The invention addresses these and other problems associated with the prior art by providing in one aspect a corner geometry-based wrap control that controls the rate at which packaging material is dispensed at least in part based on the geometrical relationship between one or more corners of the load and a packaging material dispenser. In some embodiments of the invention, for example, the spatial locations of one or more corners on a load may be determined from the dimensions of the load (e.g., the length and width) as well as any offset of the load from a center of rotation, and when combined with a sensed or calculated rotational position of the load relative to a packaging material dispenser, may be utilized to control the dispense rate of the packaging material dispenser.

In some embodiments, the determined locations of one or more corners may be used to determine when the packaging material has contacted a corner of the load during relative rotation. During relative rotation, a web of packaging material will typically extend along a line defined from an exit point of the packaging material dispenser to a point of engagement with the load, which is typically at or proximate to a corner of the load. Further rotation of the load results in a next corner eventually intersecting this line and engaging with the packaging material dispenser, at which point the next corner becomes the new point of engagement for the packaging material. In such embodiments, a wrap speed model may be used to control the dispense rate of the packaging material dispenser based upon what corner is currently acting as the point of engagement with the packaging material, and a corner rotation angle may be used to control the wrap speed model to determine when a next corner should begin to effectively drive the wrap speed model.

Therefore, consistent with one aspect of the invention, an apparatus for wrapping a load with packaging material may include a packaging material dispenser for dispensing packaging material to the load, a load support for supporting the load during wrapping, where the packaging material dispenser and the load support are adapted for rotation relative to one other about a center of rotation, and a controller configured to control a dispense rate of the packaging material dispenser during the relative rotation based at least in part on a geometric relationship between the packaging material dispenser and at least one corner of the load during the relative rotation.

Consistent with another aspect of the invention, a load may be wrapped with packaging material by providing relative rotation between a load support and a packaging material dispenser about a center of rotation to dispense packaging material to the load, controlling a dispense rate of the packaging material dispenser based at least in part on a geometric relationship between the packaging material dispenser and a current corner of the load to which the packaging material is currently engaging during the relative rotation, determining when the packaging material will engage a next corner of the load, and controlling the dispense rate based at least in part on a geometric relationship between the packaging material dispenser and the next corner of the load after the packaging material engages the next corner of the load.

These and other advantages and features, which characterize the invention, are set forth in the claims annexed hereto and forming a further part hereof. However, for a better understanding of the invention, and of the advantages and objectives attained through its use, reference should be made to the Drawings, and to the accompanying descriptive matter, in which there is described exemplary embodiments of the invention.

DETAILED DESCRIPTION

Embodiments consistent with the invention utilize in one aspect the spatial locations of one or more corners of a load in the control of the rate at which packaging material is dispensed to a load when wrapping the load with packaging material during relative rotation established between the load and a packaging material dispenser. Prior to a discussion of the aforementioned concepts, however, a brief discussion of various types of wrapping apparatus within which the various techniques disclosed herein may be implemented is provided.

In addition, the disclosures of each of U.S. Pat. No. 4,418,510, entitled "STRETCH WRAPPING APPARATUS AND PROCESS," and filed Apr. 17, 1981; U.S. Pat. No. 4,953,336, entitled "HIGH TENSILE WRAPPING APPARATUS," and filed Aug. 17, 1989; U.S. Pat. No. 4,503,658, entitled "FEEDBACK CONTROLLED STRETCH WRAPPING APPARATUS AND PROCESS," and filed Mar. 28, 1983; U.S. Pat. No. 4,676,048, entitled "SUPPLY CONTROL ROTATING STRETCH WRAPPING APPARATUS AND PROCESS," and filed May 20, 1986; U.S. Pat. No. 4,514,955, entitled "FEEDBACK CONTROLLED STRETCH WRAPPING APPARATUS AND PROCESS," and filed Apr. 6, 1981; U.S. Pat. No. 6,748,718, entitled "METHOD AND APPARATUS FOR WRAPPING A LOAD," and filed Oct. 31, 2002; U.S. Pat. No. 7,707,801, entitled "METHOD AND APPARATUS FOR DISPENSING A PREDETERMINED FIXED AMOUNT OF PRE-STRETCHED FILM RELATIVE TO LOAD GIRTH," filed Apr. 6, 2006; U.S. Pat. No. 8,037,660, entitled "METHOD AND APPARATUS FOR SECURING A LOAD TO A PALLET WITH A ROPED FILM WEB," and filed Feb. 23, 2007; U.S. Patent Application Publication No. 2007/0204565, entitled "METHOD AND APPARATUS FOR METERED PRE-STRETCH FILM DELIVERY," and filed Sep. 6, 2007; U.S. Pat. No. 7,779,607, entitled "WRAPPING APPARATUS INCLUDING METERED PRE-STRETCH FILM DELIVERY ASSEMBLY AND METHOD OF USING," and filed Feb. 23, 2007; U.S. Patent Application Publication No. 2009/0178374, entitled "ELECTRONIC CONTROL OF METERED FILM DISPENSING IN A WRAPPING APPARATUS," and filed Jan. 7, 2009; and U.S. Patent Application Publication No. 2011/0131927, entitled "DEMAND BASED WRAPPING," and filed Nov. 6, 2010, are incorporated herein by reference in their entirety.

Wrapping Apparatus Configurations

Figure 1:
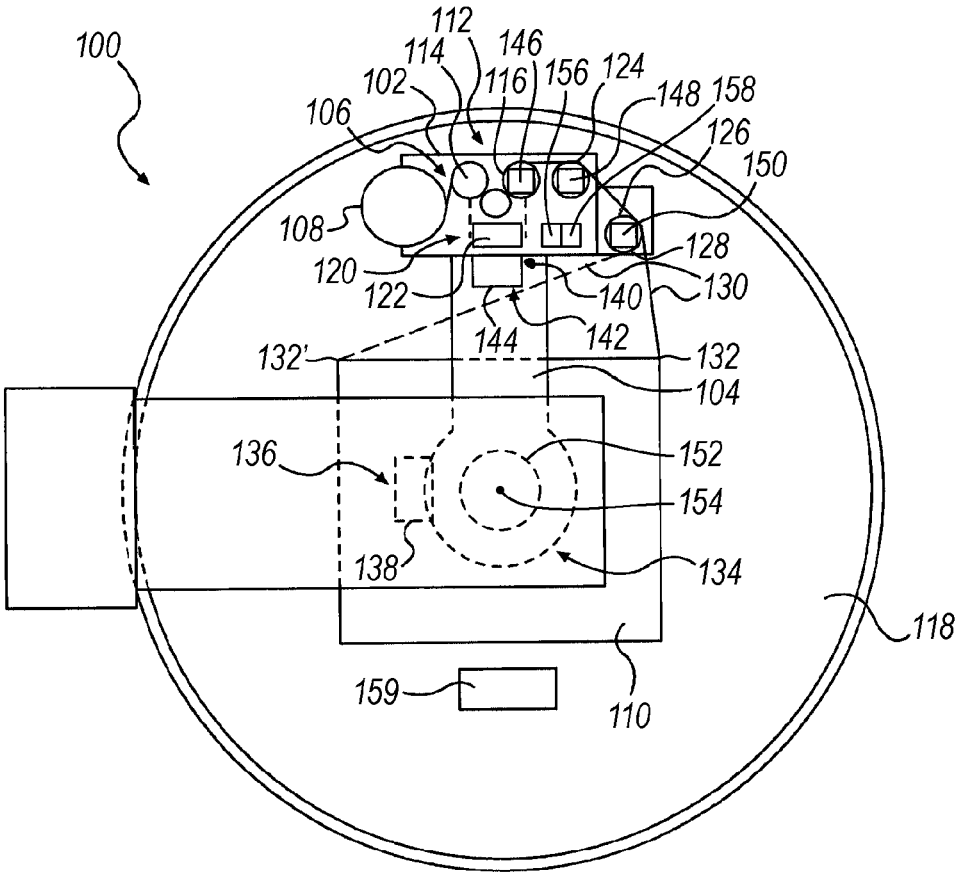
FIG. 1 shows a top view of a rotating arm-type wrapping apparatus consistent with the invention.

FIG. 1, for example, illustrates a rotating arm-type wrapping apparatus 100, which includes a roll carriage 102 mounted on a rotating arm 104. Roll carriage 102 may include a packaging material dispenser 106. Packaging material dispenser 106 may be configured to dispense packaging material 108 as rotating arm 104 rotates relative to a load 110 to be wrapped. In an exemplary embodiment, packaging material dispenser 106 may be configured to dispense stretch wrap packaging material. As used herein, stretch wrap packaging material is defined as material having a high yield coefficient to allow the material a large amount of stretch during wrapping. However, it is possible that the apparatuses and methods disclosed herein may be practiced with packaging material that will not be pre-stretched prior to application to the load. Examples of such packaging material include netting, strapping, banding, tape, etc. The invention is therefore not limited to use with stretch wrap packaging material.

Packaging material dispenser 106 may include a pre-stretch assembly 112 configured to pre-stretch packaging material before it is applied to load 110 if pre-stretching is desired, or to dispense packaging material to load 110 without pre-stretching. Pre-stretch assembly 112 may include at least one packaging material dispensing roller, including, for example, an upstream dispensing roller 114 and a downstream dispensing roller 116. It is contemplated that pre-stretch assembly 112 may include various configurations and numbers of pre-stretch rollers, drive or driven roller and idle rollers without departing from the spirit and scope of the invention.

The terms "upstream" and "downstream," as used in this application, are intended to define positions and movement relative to the direction of flow of packaging material 108 as it moves from packaging material dispenser 106 to load 110. Movement of an object toward packaging material dispenser 106, away from load 110, and thus, against the direction of flow of packaging material 108, may be defined as "upstream." Similarly, movement of an object away from packaging material dispenser 106, toward load 110, and thus, with the flow of packaging material 108, may be defined as "downstream." Also, positions relative to load 110 (or a load support surface 118) and packaging material dispenser 106 may be described relative to the direction of packaging material flow. For example, when two pre-stretch rollers are present, the pre-stretch roller closer to packaging material dispenser 106 may be characterized as the "upstream" roller and the pre-stretch roller closer to load 110

(or load support 118) and further from packaging material dispenser 106 may be characterized as the "downstream" roller.

A packaging material drive system 120, including, for example, an electric motor 122, may be used to drive dispensing rollers 114 and 116. For example, electric motor 122 may rotate downstream dispensing roller 116. Downstream dispensing roller 116 may be operatively coupled to upstream dispensing roller 114 by a chain and sprocket assembly, such that upstream dispensing roller 114 may be driven in rotation by downstream dispensing roller 116. Other connections may be used to drive upstream roller 114 or, alternatively, a separate drive (not shown) may be provided to drive upstream roller 114.

Downstream of downstream dispensing roller 116 may be provided one or more idle rollers 124, 126 that redirect the web of packaging material, with the most downstream idle roller 126 effectively providing an exit point 128 from packaging material dispenser 102, such that a portion 130 of packaging material 108 extends between exit point 128 and a contact point 132 where the packaging material engages load 110 (or alternatively contact point 132' if load 110 is rotated in a counter-clockwise direction).

Wrapping apparatus 100 also includes a relative rotation assembly 134 configured to rotate rotating arm 104, and thus, packaging material dispenser 106 mounted thereon, relative to load 110 as load 110 is supported on load support surface 118. Relative rotation assembly 134 may include a rotational drive system 136, including, for example, an electric motor 138. It is contemplated that rotational drive system 136 and packaging material drive system 120 may run independently of one another. Thus, rotation of dispensing rollers 114 and 116 may be independent of the relative rotation of packaging material dispenser 106 relative to load 110. This independence allows a length of packaging material 108 to be dispensed per a portion of relative revolution that is neither predetermined or constant. Rather, the length may be adjusted periodically or continuously based on changing conditions.

Wrapping apparatus 100 may further include a lift assembly 140. Lift assembly 140 may be powered by a lift drive system 142, including, for example, an electric motor 144, that may be configured to move roll carriage 102 vertically relative to load 110. Lift drive system 142 may drive roll carriage 102, and thus packaging material dispenser 106, upwards and downwards vertically on rotating arm 104 while roll carriage 102 and packaging material dispenser 106 are rotated about load 110 by rotational drive system 136, to wrap packaging material spirally about load 110.

One or more of downstream dispensing roller 116, idle roller 124 and idle roller 126 may include a corresponding sensor 146, 148, 150 to monitor rotation of the respective roller. In particular, rollers 116, 124 and/or 126, and/or packaging material 108 dispensed thereby, may be used to monitor a dispense rate of packaging material dispenser 106, e.g., by monitoring the rotational speed of rollers 116, 124 and/or 126, the number of rotations undergone by such rollers, the amount and/or speed of packaging material dispensed by such rollers, and/or one or more performance parameters indicative of the operating state of packaging material drive system 120, including, for example, a speed of packaging material drive system 120. The monitored characteristics may also provide an indication of the amount of packaging material 108 being dispensed and wrapped onto load 110. In addition, in some embodiments a sensor, e.g., sensor 148 or 150, may be used to detect a break in the packaging material.

Wrapping apparatus also includes an angle sensor 152 for determining an angular relationship between load 110 and packaging material dispenser 106 about a center of rotation 154. Angle sensor 152 may be implemented, for example, as a rotary encoder, or alternatively, using any number of alternate sensors or sensor arrays capable of providing an indication of the angular relationship and distinguishing from among multiple angles throughout the relative rotation, e.g., an array of proximity switches, optical encoders, magnetic encoders, electrical sensors, mechanical sensors, photodetectors, motion sensors, etc. The angular relationship may be represented in some embodiments in terms of degrees or fractions of degrees, while in other embodiments a lower resolution may be adequate. It will also be appreciated that an angle sensor consistent with the invention may also be disposed in other locations on wrapping apparatus 100, e.g., about the periphery or mounted on arm 104 or roll carriage 102. In addition, in some embodiments angular relationship may be represented and/or measured in units of time, based upon a known rotational speed of the load relative to the packaging material dispenser, from which a time to complete a full revolution may be derived such that segments of the revolution time would correspond to particular angular relationships.

Additional sensors, such as a load distance sensor 156 and/or a film angle sensor 158, may also be provided on wrapping apparatus 100. Load distance sensor 156 may be used to measure a distance from a reference point to a surface of load 110 as the load rotates relative to packaging material dispenser 106 and thereby determine a cross-sectional dimension of the load at a predetermined angular position relative to the packaging material dispenser. In one embodiment, load distance sensor 156 measures distance along a radial from center of rotation 154, and based on the known, fixed distance between the sensor and the center of rotation, the dimension of the load may be determined by subtracting the sensed distance from this fixed distance. Sensor 156 may be implemented using various types of distance sensors, e.g., a photoeye, proximity detector, laser distance measurer, ultrasonic distance measurer, electronic rangefinder, and/or any other suitable distance measuring device. Exemplary distance measuring devices may include, for example, an IFM Effector 01D100 and a Sick UM30-213118 (6036923).

Film angle sensor 158 may be used to determine a film angle for portion 130 of packaging material 108, which may be relative, for example, to a radial (not shown in FIG. 1) extending from center of rotation 154 to exit point 128 (although other reference lines may be used in the alternative).

In one embodiment, film angle sensor 158 may be implemented using a distance sensor, e.g., a photoeye, proximity detector, laser distance measurer, ultrasonic distance measurer, electronic rangefinder, and/or any other suitable distance measuring device. In one embodiment, an IFM Effector 01D100 and a Sick UM30-213118 (6036923) may be used for film angle sensor 158. In other embodiments, film angle sensor 158 may be implemented mechanically, e.g., using a cantilevered or rockered follower arm having a free end that rides along the surface of portion 130 of packaging material 108 such that movement of the follower arm tracks movement of the packaging material. In still other embodiments, a film angle sensor may be implemented by a force sensor that senses force changes resulting from movement of portion 130 through a range of film angles, or a sensor array (e.g., an image sensor) that is positioned above or below the plane of portion 130 to sense an edge of the packaging material. Additional details regarding these alternate film angle sensor implementations are discussed in greater detail below in connection with FIGS. 7, 8 and 9A-9B.

Wrapping apparatus 100 may also include additional components used in connection with other aspects of a wrapping operation. For example, a clamping device 159 may be used to grip the leading end of packaging material 108 between cycles. In addition, a conveyor (not shown) may be used to convey loads to and from wrapping apparatus 100. Other components commonly used on a wrapping apparatus will be appreciated by one of ordinary skill in the art having the benefit of the instant disclosure.

Figure 2:
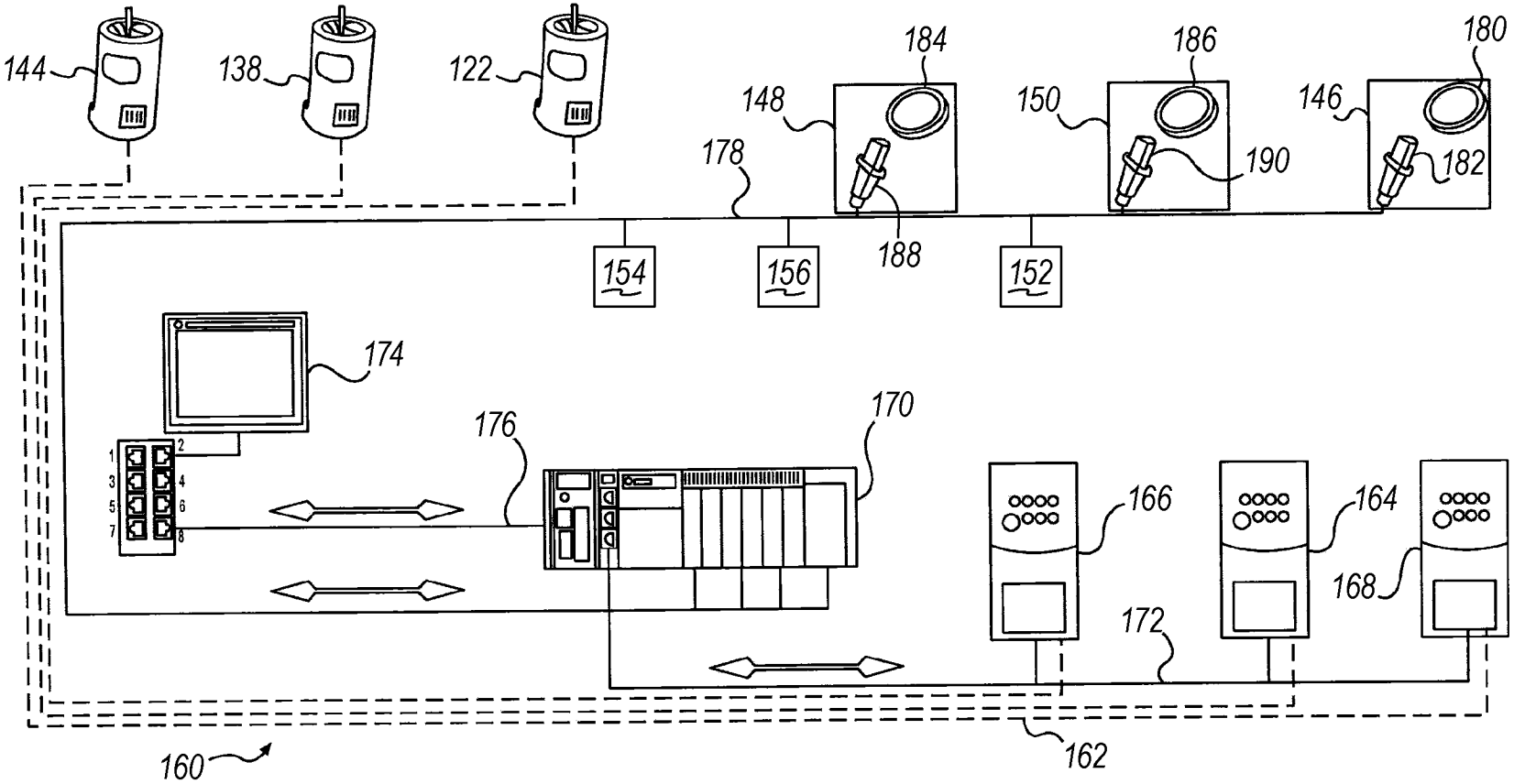
FIG. 2 is a schematic view of an exemplary control system for use in the apparatus of FIG. 1.

An exemplary schematic of a control system 160 for wrapping apparatus 100 is shown in FIG. 2. Motor 122 of packaging material drive system 120, motor 138 of rotational drive system 136, and motor 144 of lift drive system 142 may communicate through one or more data links 162 with a rotational drive variable frequency drive ("VFD") 164, a packaging material drive VFD 166, and a lift drive VFD 168, respectively. Rotational drive VFD 164, packaging material drive VFD 166, and lift drive VFD 168 may communicate with controller 170 through a data link 172. It should be understood that rotational drive VFD 164, packaging material drive VFD 166, and lift drive VFD 168 may produce outputs to controller 170 that controller 170 may use as indicators of rotational movement. For example, packaging material drive VFD 166 may provide controller 170 with signals similar to signals provided by sensor 146, and thus, sensor 146 may be omitted to cut down on manufacturing costs.

Controller 170 may include hardware components and/or software program code that allow it to receive, process, and transmit data. It is contemplated that controller 170 may be implemented as a programmable logic controller (PLC), or may otherwise operate similar to a processor in a computer system. Controller 170 may communicate with an operator interface 174 via a data link 176. Operator interface 174 may include a screen and controls that provide an operator with a way to monitor, program, and operate wrapping apparatus 100. For example, an operator may use operator interface 174 to enter or change predetermined and/or desired settings and values, or to start, stop, or pause the wrapping cycle. Controller 170 may also communicate with one or more sensors, e.g., sensors 146, 148, 150, 152, 154 and 156, as well as others not illustrated in FIG. 2, through a data link 178, thus allowing controller 170 to receive performance related data during wrapping. It is contemplated that data links 162, 172, 176, and 178 may include any suitable wired and/or wireless communications media known in the art.

As noted above, sensors 146, 148, 150, 152 may be configured in a number of manners consistent with the invention. In one embodiment, for example, sensor 146 may be configured to sense rotation of downstream dispensing roller 116, and may include one or more magnetic transducers 180 mounted on downstream dispensing roller 116, and a sensing device 182 configured to generate a pulse when the one or more magnetic transducers 180 are brought into proximity of sensing device 182. Alternatively, sensor assembly 146 may include an encoder configured to monitor rotational movement, and capable of producing, for example, 360 or 720 signals per revolution of downstream dispensing roller 116 to provide an indication of the speed or other characteristic of rotation of downstream dispensing roller 116. The encoder may be mounted on a shaft of downstream dispensing roller 116, on electric motor 122, and/or any other suitable area. One example of a sensor assembly that may be used is anEncoder Products Company model 15H optical encoder. Other suitable sensors and/or encoders may be used for monitoring, such as, for example, optical encoders, magnetic encoders, electrical sensors, mechanical sensors, photodetectors, and/or motion sensors.

Likewise, for sensors 148 and 150, magnetic transducers 184, 186 and sensing devices 188, 190 may be used to monitor rotational movement, while for sensor 152, a rotary encoder may be used to determine the angular relationship between the load and packaging material dispenser. Any of the aforementioned alternative sensor configurations may be used for any of sensors 146, 148, 150, 152, 154 and 156 in other embodiments, and as noted above, one or more of such sensors may be omitted in some embodiments. Additional sensors capable of monitoring other aspects of the wrapping operation may also be coupled to controller 170 in other embodiments.

For the purposes of the invention, controller 170 may represent practically any type of computer, computer system, controller, logic controller, or other programmable electronic device, and may in some embodiments be implemented using one or more networked computers or other electronic devices, whether located locally or remotely with respect to wrapping apparatus 100. Controller 170 typically includes a central processing unit including at least one microprocessor coupled to a memory, which may represent the random access memory (RAM) devices comprising the main storage of controller 170, as well as any supplemental levels of memory, e.g., cache memories, non-volatile or backup memories (e.g., programmable or flash memories), read-only memories, etc. In addition, the memory may be considered to include memory storage physically located elsewhere in controller 170, e.g., any cache memory in a processor in CPU 52, as well as any storage capacity used as a virtual memory, e.g., as stored on a mass storage device or on another computer or electronic device coupled to controller 170. Controller 170 may also include one or more mass storage devices, e.g., a floppy or other removable disk drive, a hard disk drive, a direct access storage device (DASD), an optical drive (e.g., a CD drive, a DVD drive, etc.), and/or a tape drive, among others. Furthermore, controller 170 may include an interface with one or more networks (e.g., a LAN, a WAN, a wireless network, and/or the Internet, among others) to permit the communication of information to the components in wrapping apparatus 100 as well as with other computers and electronic devices. Controller 170 operates under the control of an operating system, kernel and/or firmware and executes or otherwise relies upon various computer software applications, components, programs, objects, modules, data structures, etc. Moreover, various applications, components, programs, objects, modules, etc. may also execute on one or more processors in another computer coupled to controller 170, e.g., in a distributed or client-server computing environment, whereby the processing required to implement the functions of a computer program may be allocated to multiple computers over a network.

In general, the routines executed to implement the embodiments of the invention, whether implemented as part of an operating system or a specific application, component, program, object, module or sequence of instructions, or even a subset thereof, will be referred to herein as "computer program code," or simply "program code." Program code typically comprises one or more instructions that are resident at various times in various memory and storage devices in a computer, and that, when read and executed by one or more processors in a computer, cause that computer to perform the steps necessary to execute steps or elements embodying the various aspects of the invention. Moreover, while the invention has and hereinafter will be described in the context of fully functioning controllers, computers and computer systems, those skilled in the art will appreciate that the various embodiments of the invention are capable of being distributed as a program product in a variety of forms, and that the invention applies equally regardless of the particular type of computer readable media used to actually carry out the distribution.

Such computer readable media may include computer readable storage media and communication media. Computer readable storage media is non-transitory in nature, and may include volatile and non-volatile, and removable and non-removable media implemented in any method or technology for storage of information, such as computer-readable instructions, data structures, program modules or other data. Computer readable storage media may further include RAM, ROM, erasable programmable read-only memory (EPROM), electrically erasable programmable read-only memory (EEPROM), flash memory or other solid state memory technology, CD-ROM, digital versatile disks (DVD), or other optical storage, magnetic cassettes, magnetic tape, magnetic disk storage or other magnetic storage devices, or any other medium that can be used to store the desired information and which can be accessed by controller 170. Communication media may embody computer readable instructions, data structures or other program modules. By way of example, and not limitation, communication media may include wired media such as a wired network or direct-wired connection, and wireless media such as acoustic, RF, infrared and other wireless media. Combinations of any of the above may also be included within the scope of computer readable media.

Various program code described hereinafter may be identified based upon the application within which it is implemented in a specific embodiment of the invention. However, it should be appreciated that any particular program nomenclature that follows is used merely for convenience, and thus the invention should not be limited to use solely in any specific application identified and/or implied by such nomenclature. Furthermore, given the typically endless number of manners in which computer programs may be organized into routines, procedures, methods, modules, objects, and the like, as well as the various manners in which program functionality may be allocated among various software layers that are resident within a typical computer (e.g., operating systems, libraries, API's, applications, applets, etc.), it should be appreciated that the invention is not limited to the specific organization and allocation of program functionality described herein.

Figure 3:
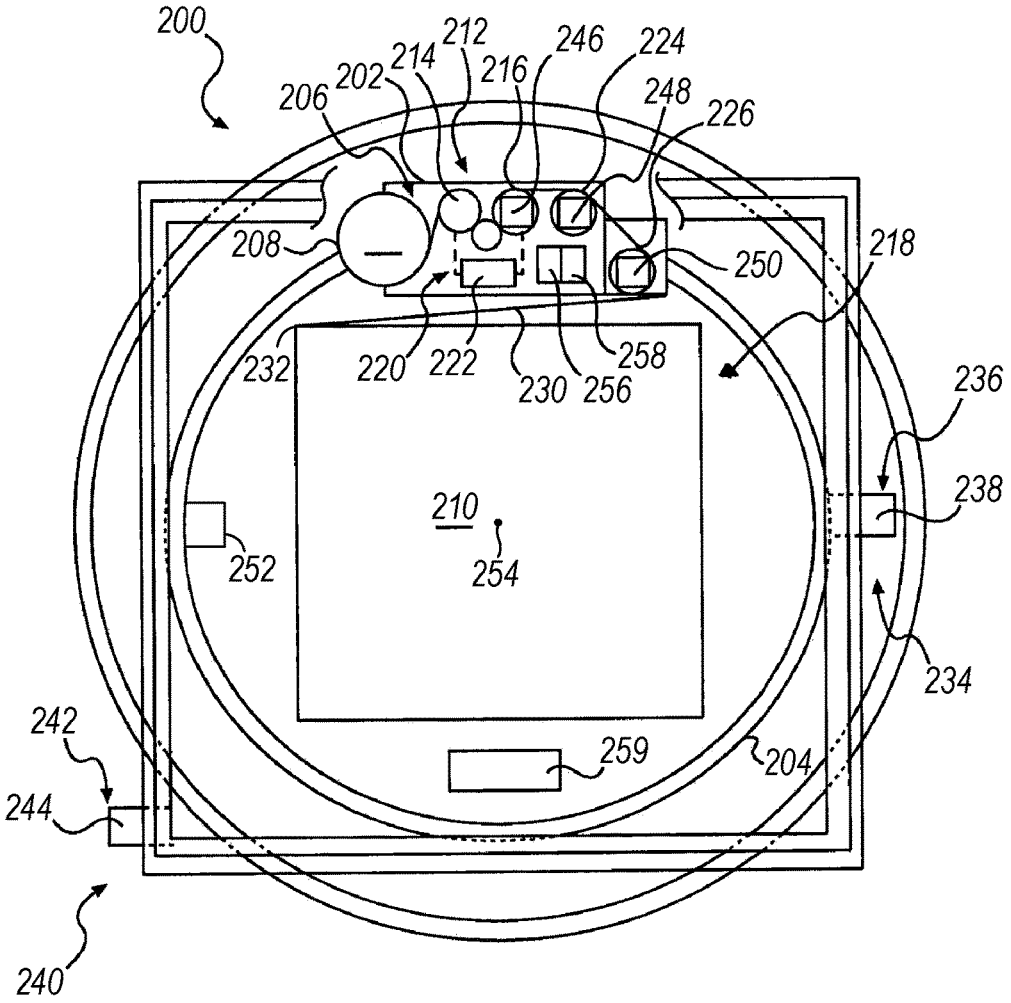
FIG. 3 shows a top view of a rotating ring-type wrapping apparatus consistent with the invention.

Now turning to FIG. 3, a rotating ring-type wrapping apparatus 200 is illustrated. Wrapping apparatus 200 may include elements similar to those shown in relation to wrapping apparatus 100 of FIG. 1, including, for example, a roll carriage 202 including a packaging material dispenser 206 configured to dispense packaging material 208 during relative rotation between roll carriage 202 and a load 210 disposed on a load support 218. However, a rotating ring 204 is used in wrapping apparatus 200 in place of rotating arm 104 of wrapping apparatus 100. In many other respects, however, wrapping apparatus 200 may operate in a manner similar to that described above with respect to wrapping apparatus 100.

Packaging material dispenser 206 may include a pre-stretch assembly 212 including an upstream dispensing roller 214 and a downstream dispensing roller 216, and a packaging material drive system 220, including, for example, an electric motor 222, may be used to drive dispensing rollers 214 and 216. Downstream of downstream dispensing roller 216 may be provided one or more idle rollers 224, 226, with the most downstream idle roller 226 effectively providing an exit point 228 from packaging material dispenser 206, such that a portion 230 of packaging material 208 extends between exit point 228 and a contact point 232 where the packaging material engages load 210.

Wrapping apparatus 200 also includes a relative rotation assembly 234 configured to rotate rotating ring 204, and thus, packaging material dispenser 206 mounted thereon, relative to load 210 as load 210 is supported on load support surface 218. Relative rotation assembly 234 may include a rotational drive system 236, including, for example, an electric motor 238. Wrapping apparatus 200 may further include a lift assembly 240, which may be powered by a lift drive system 242, including, for example, an electric motor 244, that may be configured to move rotating ring 204 and roll carriage 202 vertically relative to load 210.

In addition, similar to wrapping apparatus 100, wrapping apparatus 200 may include sensors 246, 248, 250 on one or more of downstream dispensing roller 216, idle roller 224 and idle roller 226. Furthermore, an angle sensor 252 may be provided for determining an angular relationship between load 210 and packaging material dispenser 206 about a center of rotation 254, and in some embodiments, one or both of a load distance sensor 256 and a film angle sensor 258 may also be provided. Sensor 252 may be positioned proximate center of rotation 254, or alternatively, may be positioned at other locations, such as proximate rotating ring 204. Wrapping apparatus 200 may also include additional components used in connection with other aspects of a wrapping operation, e.g., a clamping device 259 may be used to grip the leading end of packaging material 208 between cycles.

Figure 4:
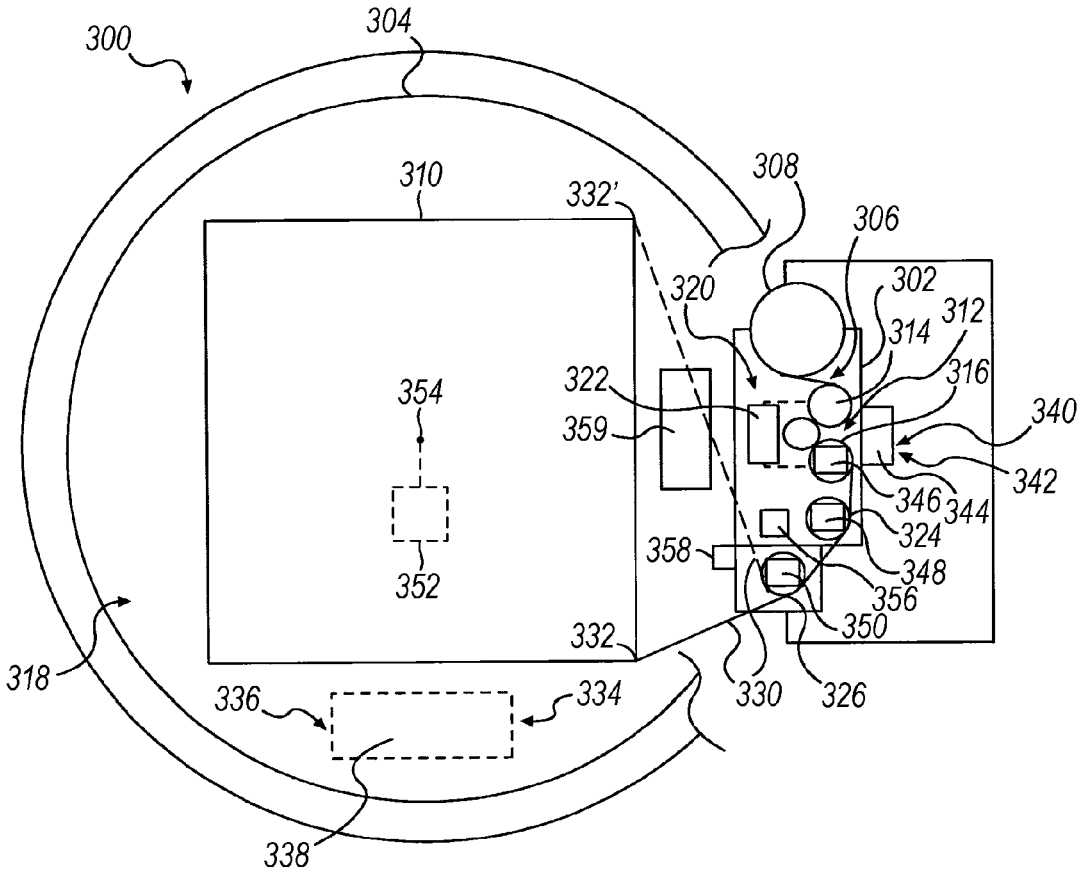
FIG. 4 shows a top view of a turntable-type wrapping apparatus consistent with the invention.

FIG. 4 likewise shows a turntable-type wrapping apparatus 300, which may also include elements similar to those shown in relation to wrapping apparatus 100 of FIG. 1. However, instead of a roll carriage 102 that rotates around a fixed load 110 using a rotating arm 104, as in FIG. 1, wrapping apparatus 300 includes a rotating turntable 304 functioning as a load support 318 and configured to rotate load 310 about a center of rotation 354 while a packaging material dispenser 306 disposed on a dispenser support 302 remains in a fixed location about center of rotation 354 while dispensing packaging material 308. In many other respects, however, wrapping apparatus 300 may operate in a manner similar to that described above with respect to wrapping apparatus 100.

Packaging material dispenser 306 may include a pre-stretch assembly 312 including an upstream dispensing roller 314 and a downstream dispensing roller 316, and a packaging material drive system 320, including, for example, an electric motor 322, may be used to drive dispensing rollers 314 and 316, and downstream of downstream dispensing roller 316 may be provided one or more idle rollers 324, 326, with the most downstream idle roller 326 effectively providing an exit point 328 from packaging material dispenser 306, such that a portion 330 of packaging material 308 extends between exit point 328 and a contact point 332 (or alternatively contact point 332' if load 310 is rotated in a counter-clockwise direction) where the packaging material engages load 310.

Wrapping apparatus 300 also includes a relative rotation assembly 334 configured to rotate turntable 304, and thus, load 310 supported thereon, relative to packaging material dispenser 306. Relative rotation assembly 334 may include a rotational drive system 336, including, for example, an electric motor 338. Wrapping apparatus 300 may further include a lift assembly 340, which may be powered by a lift drive system 342, including, for example, an electric motor 344, that may be configured to move dispenser support 302 and packaging material dispenser 306 vertically relative to load 310.

In addition, similar to wrapping apparatus 100, wrapping apparatus 300 may include sensors 346, 348, 350 on one or more of downstream dispensing roller 316, idle roller 324 and idle roller 326. Furthermore, an angle sensor 352 may be provided for determining an angular relationship between load 310 and packaging material dispenser 306 about a center of rotation 354, and in some embodiments, one or both of a load distance sensor 356 and a film angle sensor 358 may also be provided. Sensor 352 may be positioned proximate center of rotation 354, or alternatively, may be positioned at other locations, such as proximate the edge of turntable 304. Wrapping apparatus 300 may also include additional components used in connection with other aspects of a wrapping operation, e.g., a clamping device 359 may be used to grip the leading end of packaging material 308 between cycles.

Each of wrapping apparatus 200 of FIG. 3 and wrapping apparatus 300 of FIG. 4 may also include a controller (not shown) similar to controller 170 of FIG. 2, and receive signals from one or more of the aforementioned sensors and control packaging material drive system 220, 320 during relative rotation between load 210, 310 and packaging material dispenser 206, 306.

Those skilled in the art will recognize that the exemplary environments illustrated in FIGS. 1-4 are not intended to limit the present invention. Indeed, those skilled in the art will recognize that other alternative environments may be used without departing from the scope of the invention.

Effective Circumference-Based Wrapping

As noted above, embodiments consistent with the invention utilize in one aspect the effective circumference of a load to dynamically control the rate at which packaging material is dispensed to a load when wrapping the load with packaging material during relative rotation established between the load and a packaging material dispenser.

It will be appreciated that in many wrapping applications, the rate at which packaging material is dispensed is also controlled based on a desired payout percentage, which in general relates to the amount of wrap force applied to the load by the packaging material during wrapping. Further details regarding the concept of payout percentage may be found, for example, in the aforementioned U.S. Pat. No. 7,707,801, which has been incorporated by reference.

In many embodiments, for example, a payout percentage may have a range of about 80% to about 120% Decreasing the payout percentage slows the rate at which packaging material exits the packaging material dispenser compared to the relative rotation of the load such that the packaging material is pulled tighter around the load, thereby increasing containment force. In contrast, increasing the payout percentage decreases the wrap force. For the purposes of simplifying the discussion hereinafter, however, a payout percentage of 100% is initially assumed. It will be appreciated also that other metrics may be used as an alternative to payout percentage to reflect the relative amount of wrap force to be applied during wrapping, so the invention is not so limited.

Figure 5:
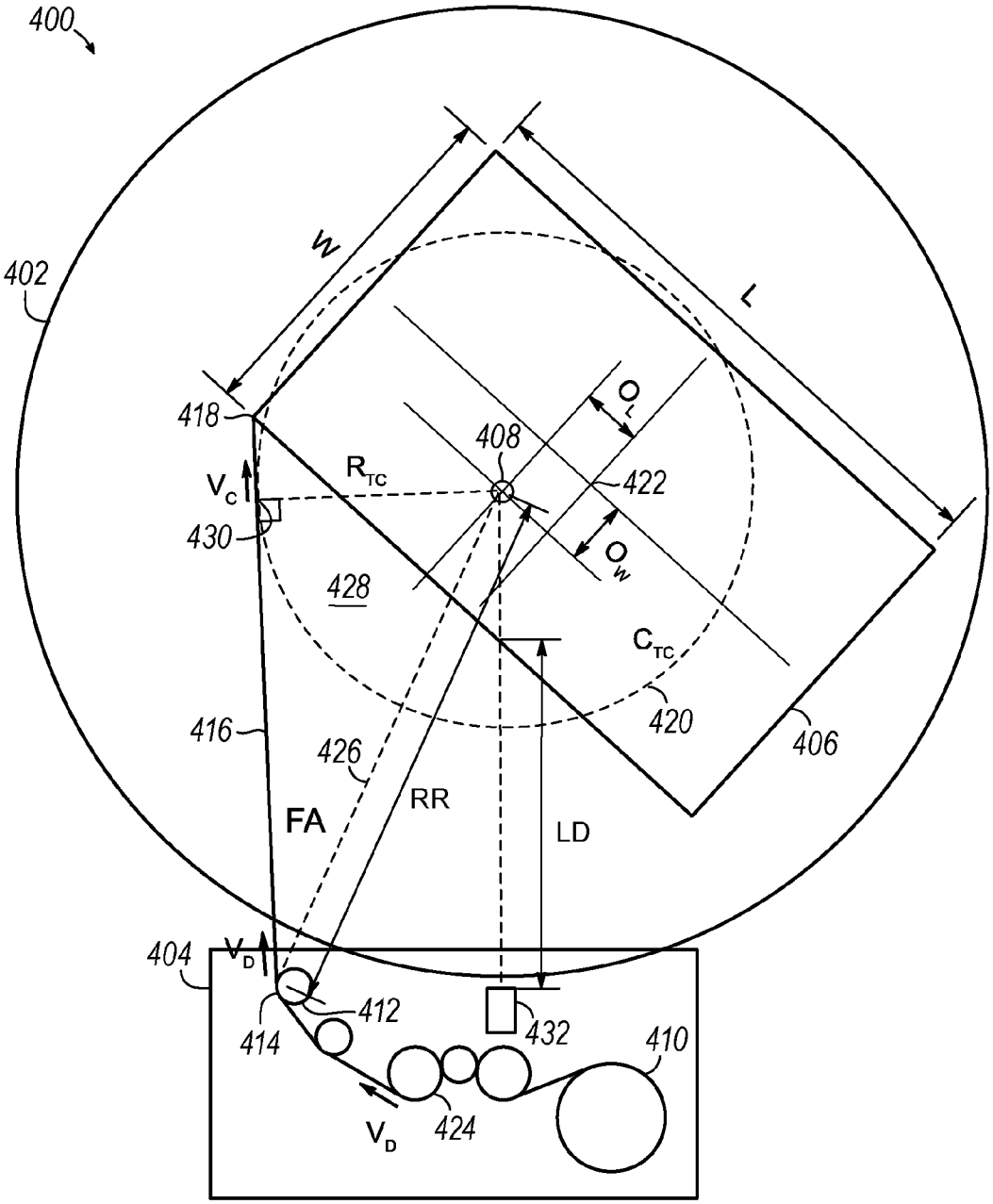
FIG. 5 is a top view of a packaging material dispenser and a load, illustrating a tangent circle defined for the load throughout relative rotation between the packaging material dispenser and the load.

FIG. 5, for example, functionally illustrates a wrapping apparatus 400 in which a load support 402 and packaging material dispenser 404 are adapted for relative rotation with one another to rotate a load 406 about a center of rotation 408 and thereby dispense a packaging material 410 for wrapping around the load. In this illustration, the relative rotation is in a clockwise direction relative to the load (i.e., the load rotates clockwise relative to the packaging material dispenser, while the packaging material dispenser may be considered to rotate in a counter-clockwise direction around the load).

In embodiments consistent with the invention, the effective circumference of a load throughout relative rotation is indicative of an effective consumption rate of the load, which is in turn indicative of the amount of packaging material being "consumed" by the load as the load rotates relative to the packaging dispenser. In particular, effective consumption rate, as used herein, generally refers to a rate at which packaging material would need to be dispensed by the packaging material dispenser in order to substantially match the tangential velocity of a tangent circle that is substantially centered at the center of rotation of the load and substantially tangent to a line substantially extending between a first point proximate to where the packaging material exits the dispenser and a second point proximate to where the packaging material engages the load. This line is generally coincident with the web of packaging material between where the packaging material exits the dispenser and where the packaging material engages the load.

As shown in FIG. 5, for example, an idle roller 412 defines an exit point 414 for packaging material dispenser 404, such that a portion of web 416 of packaging material 410 extends between this exit point 414 and an engagement point 418 at which the packaging material 410 engages load 406. In this arrangement, a tangent circle 420 is tangent to portion 416 and is centered at center of rotation 408.

The tangent circle has a circumference $C_{TC}$, which for the purposes of this invention, is referred to as the "effective circumference" of the load. Likewise, other dimensions of the tangent circle, e.g., the radius $R_{TC}$ and diameter $D_{TC}$, may be respectively referred to as the "effective radius" and "effective diameter" of the load.

It has been found that for a load having a non-circular cross-section, as the load rotates relative to the dispenser about center of rotation 408, the size (i.e., the circumference, radius and diameter) of tangent circle 420 dynamically varies, and that the size of tangent circle 420 throughout the rotation effectively models, at any given angular position of the load relative to the dispenser, a rate at which packaging material should be dispensed in order to match the consumption rate of the load, i.e., where the dispense rate in terms of linear velocity (represented by arrow $V_D$) is substantially equal to the tangential velocity of the tangent circle (represented by arrow $V_C$). Thus, in situations where a payout percentage of 100% is desired, the desired dispense rate of the packaging material may be set to substantially track the dynamically changing tangential velocity of the tangent circle.

Of note, the tangent circle is dependent not only on the dimensions of the load (i.e., the length L and width W), but also the offset of the geometric center 422 of the load from the center of rotation 408, illustrated in FIG. 5 as $O_L$ and $O_W$. Given that in many applications, a load will not be perfectly centered when it is placed or conveyed onto the load support, the dimensions of the load, by themselves, typically do not present a complete picture of the effective consumption rate of the load. Nonetheless, as will become more apparent below, the calculation of the dimensions of the tangent circle, and thus the effective consumption rate, may be determined without determining the actual dimensions and/or offset of the load in many embodiments.

It has been found that this tangent circle, when coupled with the web of packaging material and the drive roller (e.g., drive roller 424), functions in much the same manner as a belt drive system, with tangent circle 420 functioning as the driver pulley, dispenser drive roller 424 functioning as the follower pulley, and web 416 of packaging material functioning as the belt. For example, let $N_d$ be the rotational velocity of a driver pulley in RPM, $N_f$ be the rotational velocity of a follower pulley in RPM, $R_d$ be the radius of the driver pulley and $R_f$ be the radius of the follower pulley. Consider the length of belt that passes over each of the driver pulley and the follower pulley in one minute, which is equal to the circumference of the respective pulley (diameter*π, or radius*2π) multiplied by the rotational velocity:

$$L_d=2\pi*R_d*N_d \tag{1}$$

$$L_f=2\pi*R_f*N_f \tag{2}$$

where $L_d$ is the length of belt that passes over the driver pulley in one minute, and $L_f$ is the length of belt that passes over the follower pulley in one minute.

In this theoretical system, the point at which neither pulley applied a tensile or compressive force to the belt (which generally corresponds to a payout percentage of 100%) would be achieved when the tangential velocities, i.e., the linear velocities at the surfaces or rims of the pulleys, were equal. Put another way, when the length of belt that passes over each pulley over the same time period is equal, i.e., $L_d=L_f$. Therefore:

$$2\pi*R_d*N_d=2\pi*R_f*N_f \tag{3}$$

Consequently, the velocity ratio VR of the rotational velocities of the driver and follower pulleys is:

$$VR=\frac{N_d}{N_f}=\frac{R_f}{R_d} \tag{4}$$

Alternatively, the velocity ratio may be expressed in terms of the ratio of diameters or of circumferences:

$$VR=\frac{N_d}{N_f}=\frac{D_f}{D_d} \tag{5}$$

$$VR=\frac{N_d}{N_f}=\frac{C_f}{C_d} \tag{6}$$

where $D_f$, $D_d$ are the respective diameters of the follower and driver pulleys, and $C_f$, $C_d$ are the respective circumferences of the follower and driver pulleys.

Returning to equations (1) and (2) above, the values $L_d$ and $L_f$ represent the length of belt that passes the driver and follower pulleys in one minute. Thus, when the tangent circle for the load is considered a driver pulley, the effective consumption rate (ECR) may be considered to be equal to the length of packaging material that passes the tangent circle in a fixed amount of time, e.g., per minute:

$$\text{ECR}=C_{TC}*N_{TC}=2\pi*R_{TC}*N_{TC} \tag{7}$$

where $C_{TC}$ is the circumference of the tangent circle, $N_{TC}$ is the rotational velocity of the tangent circle (e.g., in revolutions per minute (RPM)), and $R_{TC}$ is the radius of the tangent circle.

Therefore, given a known rotational velocity for the load, a known circumference of the tangent circle at a given instant and a known circumference for the drive roller, the rotational velocity of the drive roller necessary to provide a dispense rate that substantially matches the effective consumption rate is:

$$N_{DR}=\frac{C_{TC}}{C_{DR}}*N_L \tag{8}$$

where $N_{DR}$ is the rotational rate of the drive roller, $C_{TC}$ is the circumference of the tangent circle and the effective circumference of the load, CDR is the circumference of the drive roller and NL is the rotational rate of the load relative to the dispenser.

In addition, should it be desirable to scale the rotational rate of the drive roller to provide a controlled payout percentage (PP), and thereby provide a desired containment force and/or a desired packaging material use efficiency, equation (8) may be modified as follows:

$$N_{DR}=\frac{C_{TC}}{C_{DR}}*N_L*PP \tag{9}$$

Figure 6:
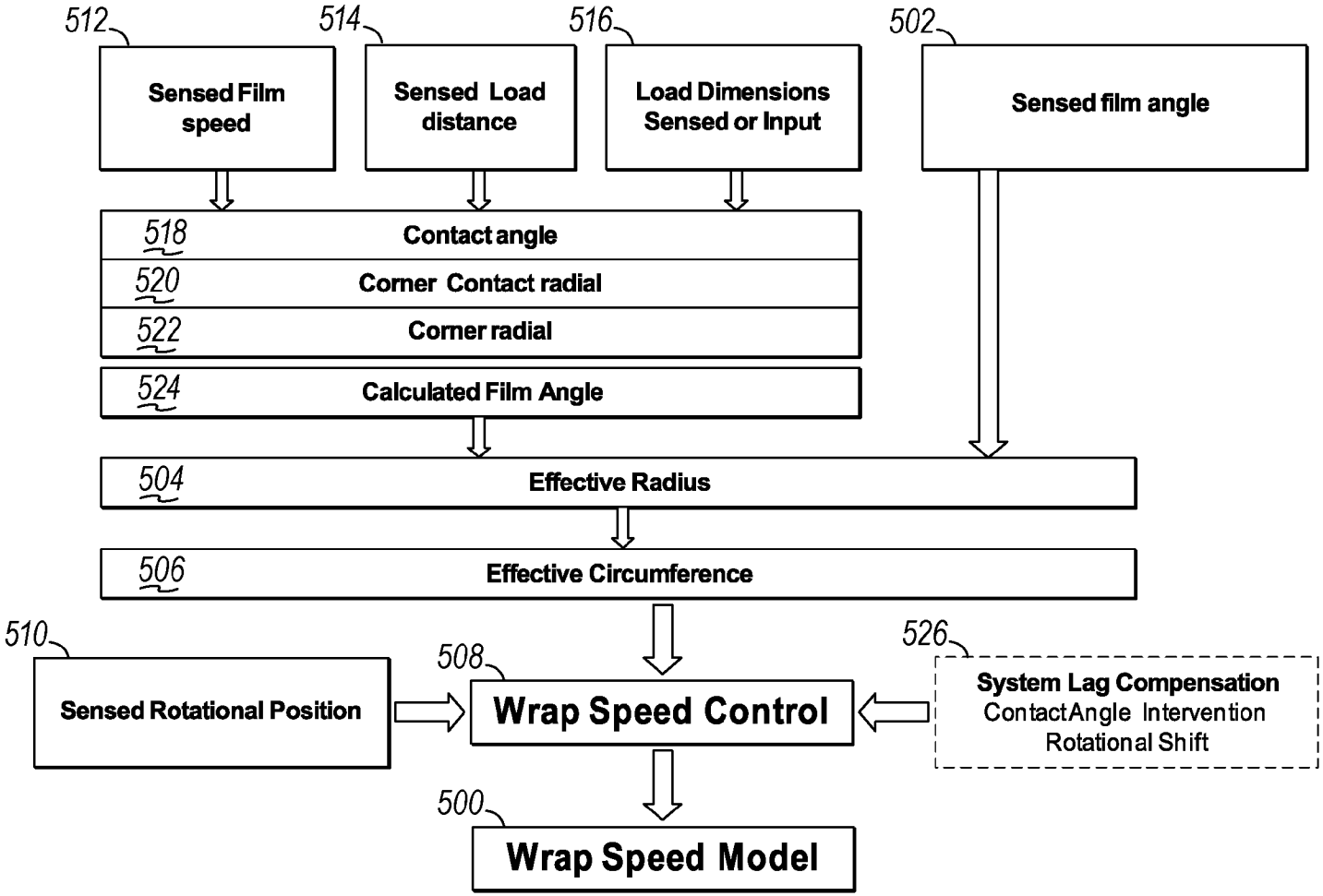
FIG. 6 is a block diagram of various inputs to a wrap speed model consistent with the invention.

The manner in which the dimensions (i.e., circumference, diameter and/or radius) of the tangent circle may be calculated or otherwise determined may vary in different embodiments. For example, as illustrated in FIG. 6, a wrap speed model 500, representing the control algorithm by which to drive a packaging material dispenser to dispense packaging material at a desired dispense rate during relative rotation with a load, may be responsive to a number of different control inputs.

In some embodiments, for example, a sensed film angle (block 502) may be used to determine various dimensions of a tangent circle, e.g., effective radius (block 504) and/or effective circumference (block 506). As shown in FIG. 5, for example, a film angle FA may be defined as the angle at exit point 414 between portion 416 of packaging material 410 (to which tangent circle 420 is tangent) and a radial or radius 426 extending from center of rotation 408 to exit point 414.

Returning to FIG. 6, the film angle sensed in block 502, e.g., using an encoder and follower arm or other electronic sensor, is used to determine one or more dimensions of the tangent circle (e.g., effective radius, effective circumference and/or effective diameter), and from these determined dimensions, a wrap speed control algorithm 508 determines a dispense rate. In many embodiments, wrap speed control algorithm 508 also utilizes the angular relationship between the load and the packaging material dispenser, i.e., the sensed rotational position of the load, as an input such that, for any given rotational position or angle of the load (e.g., at any of a plurality of angles defined in a full revolution), a desired dispense rate for the determined tangent circle may be determined.

Alternatively or in addition to the use of sensed film angle, various additional inputs may be used to determine dimensions of a tangent circle. As shown in block 512, for example, a film speed sensor, such as an optical or magnetic encoder on an idle roller, may be used to determine the speed of the packaging material as the packaging material exits the packaging material dispenser. In addition, as shown in block 514, a laser or other distance sensor may be used to determine a load distance (i.e., the distance between the surface of the load at a particular rotational position and a reference point about the periphery of the load). Furthermore, as shown in block 516, the dimensions of the load, e.g., length, width and/or offset, may either be input manually by a user, may be received from a database or other electronic data source, or may be sensed or measured.

From any or all of these inputs, one or more dimensions of the load, such as corner contact angles (block 518), corner contact radials (block 520), and/or corner radials (block 522) may be used to determine a calculated film angle, such that this calculated film angle may be used in lieu of or in addition to any sensed film angle to determine one or more dimensions of the tangent circle. Thus, the calculated film angle may be used by the wrap speed control algorithm in a similar manner to the sensed film angle described above.

Moreover, as will be discussed in greater detail below, in some embodiments additional modifications may be applied to wrap speed control algorithm 508 to provide more accurate control over the dispense rate. As shown in block 526, for example, a compensation may be performed to address system lag. In some embodiments, for example, a controlled intervention may be performed to effectively anticipate contact of a corner of the load with the packaging material. In addition, in some embodiments, a rotational shift may be performed to better align collected data with the control algorithm and thereby account for various lags in the system.

Effective Circumference Based on Sensed Film Angle

Returning to FIG. 5, when sensed film angle is used in a wrap speed model consistent with the invention, the effective circumference may be determined based upon the right triangle 428 defined by center of rotation 408, exit point 414, and a tangent point 430 where web 416 of packaging material 410 intersects with tangent circle 420. Given that an effective radius $R_{TC}$ extending between center of rotation 408 and point 430 forms a right angle with web 416, and further given that the length of the rotation radial (RR), i.e., the radius 426 from center of rotation 408 to exit point 414, is known, the effective radius $R_{TC}$ may be calculated using the film angle (FA) and length RR as follows:

$$R_{TC}=\mathrm{RR}*\sin(\mathrm{FA}) \tag{10}$$

Furthermore, the effective circumference $C_{TC}$ may be calculated from the effective radius as follows:

$$C_{TC}=2\pi*R_{TC}=2\pi*\mathrm{RR}*\sin(\mathrm{FA}) \tag{11}$$

Thereafter, equation (9) may be used to control the dispense rate in the manner disclosed above.

In some embodiments, exit point 414 is defined at a fixed point proximate idle roller 412, e.g., proximate a tangent point at which web 416 disengages from idle roller 412 when web 416 is about half-way between the maximum and minimum film angles through which the web passes for a particular load, or alternatively, for all expected loads that may be wrapped by wrapping apparatus 400. Alternatively, exit point 414 may be defined at practically any other point along the surface of idle roller 412, or even at the center of rotation thereof. In other embodiments, however, it may be desirable to dynamically determine the exit point based on the angle at which web 416 exits the dispenser. Other dynamically or statically-defined exit points proximate the packaging material dispenser may be used in other embodiments consistent with the invention.

As previously noted, film angle may be sensed in a number of manners consistent with the invention. For example, as illustrated in FIGS. 1-3, a film angle sensor 158, 258, 358 may be implemented using a distance sensor that measures distance between the plane of the web of packaging material and the fixed location of the sensor.

Figure 7:
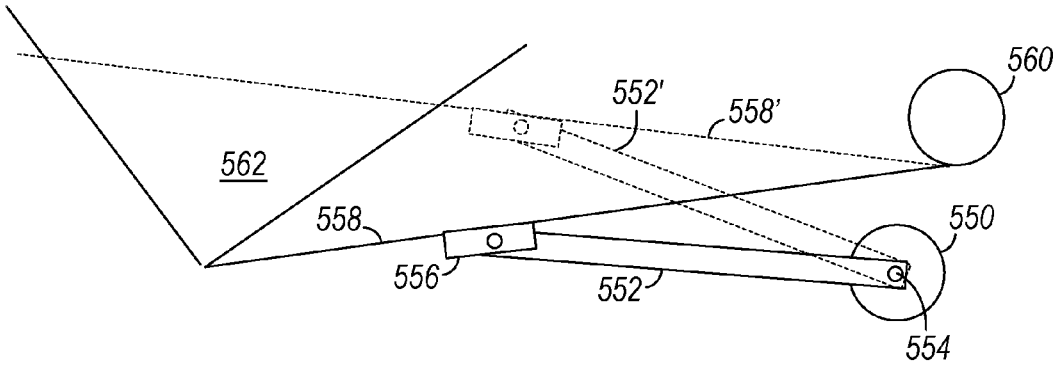
FIG. 7 is a top view of a mechanical film angle sensor consistent with the invention.

Alternatively, as illustrated in FIG. 7, a film angle sensor 550 may be mechanical in nature, and utilize a cantilevered or rockered follower arm 552 that rotates about an axis 554 and includes a foot 556 that rides along the surface of a web 558 of packaging material extending between an exit roller 560 on the packaging material dispenser and the point of engagement with a load 562. Thus, for example, as the web deflects to a position 558' as a result of rotation of load 562, arm 552 rotates to a position 552'. Sensor 550 may include, for example, a rotary encoder or other angle sensor to determine the angle of arm 552, and thus, the corresponding film angle. It will be appreciated that arm 552 may be spring loaded or otherwise tensioned against web 558 such that foot 556 rides along the web throughout the rotation of the load. Furthermore, foot 556 may include rollers or a low friction surface to minimize drag on the web of packaging material. In addition, other manners of detecting the relative position of arm 552 and/or foot 556, e.g., a distance sensor directed at the arm, foot or other portion of the assembly, may also be used.

Figure 8:
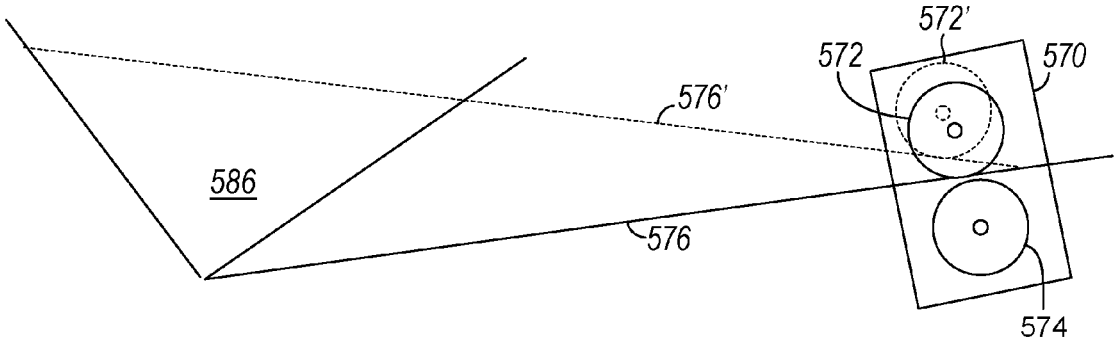
FIG. 8 is a top view of a force-based film angle sensor consistent with the invention.

As another alternative, as illustrated in FIG. 8, a film angle sensor 570 may be implemented as a force sensor that senses force changes resulting from movement of the web through a range of film angles. In particular, a pair of roller 572, 574 may be provided as an exit point for a packaging material dispenser, such that a web 576 projects through the rollers 572, 574 and engages a load 578. Each roller 572, 574 may be coupled to a force sensor that measures the force applied perpendicular to the rotational axis of each roller by web 576. Furthermore, in some embodiments, the axle of each roller 572, 574 may be configured to move perpendicular relative to the axis of rotation. Thus, for example, as web 576 deflects to a position 576' as a result of rotation of load 578, a force is applied to roller 572, displacing the roller to the position shown at 572'. It will be appreciated that the amount of force applied is proportional to the film angle, and thus the film angle may be derived from the force measurement.

In some embodiments, rollers 572, 574 may be mounted for linear displacement or displacement along an arc. In other embodiments, rollers 572, 574 may not be displaced through the application of force. In still other embodiments, only one roller may be used, while in other embodiments, rollers 572, 574 may be replaced with low friction surfaces over which the web passes during wrapping.

Figure 9A:
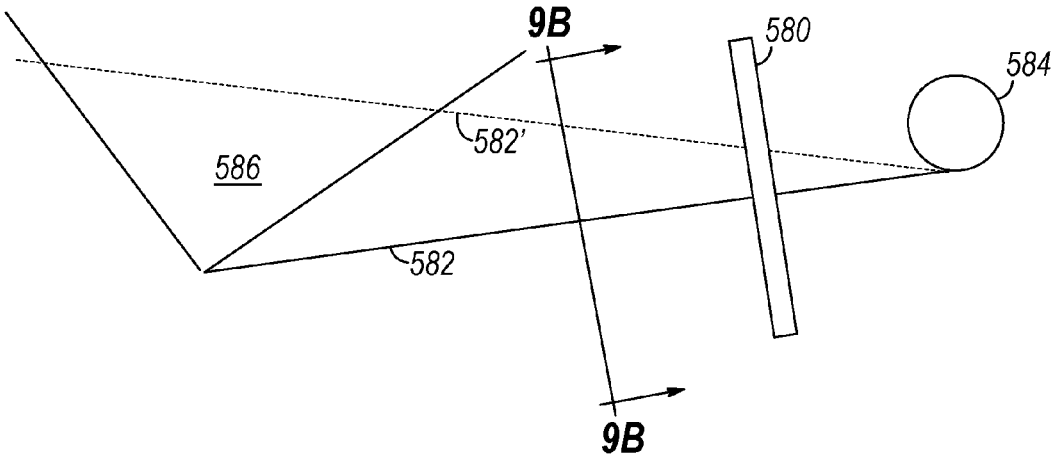
FIG. 9A is a top view of a light curtain film angle sensor consistent with the invention.
Figure 9B:
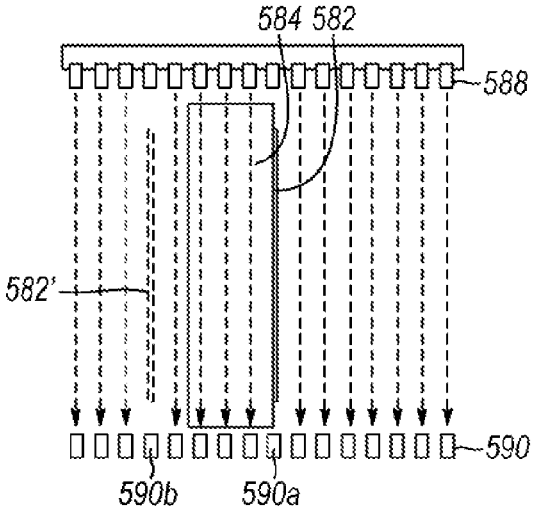
FIG. 9B is a cross-sectional view of the light curtain film angle sensor of FIG. 9A, taken along lines 9B-9B.

As another alternative, as illustrated in FIGS. 9A-9B, an array of sensors, e.g., in the form of a light curtain 580, may be positioned above and/or below a web 582 of packaging material between an exit roller 584 of a packaging material dispenser and a point of engagement with a load 586 to effective sense the position of an edge of the packaging material. As shown in FIG. 9B, light curtain 580 may include an array of transmitters 588 opposing an array of receivers 590, with each transmitter 588 emitting a beam such as an infrared light beam or a laser beam that is sensed by a corresponding receiver 590. Whenever web 582 passes between a corresponding pair of transmitter 588 and receiver 590, the beam is interrupted and thus the position of the web may be determined. Thus, for example, when the web is positioned as shown at 582, a receiver 590*a* does not detect a beam, while when the web is positioned as shown at 582', a receiver 590*b* does not detect a beam.

It will be appreciated that the positions of transmitters 588 and receivers 590 may be swapped relative to one another, and that in some embodiments, a reflective surface may be used along one edge of the web such that the transmitters and receivers may both be positioned along the same edge of the web. In other embodiments, a sensor array may be implemented using an image sensor, such as in a digital camera, with image processing techniques used to detect the position of the web in a digital image. In still other embodiments, a laser or infrared scanner, e.g., as used in bar code readers, may be used.

It will also be appreciated that in any of the aforementioned film angle sensor implementations, various lighting or illumination techniques may be used to improve sensing of the packaging material, and in some embodiments, the packaging material may be tinted or colored to improve recognition. Other modifications will be apparent to one of ordinary skill in the art having the benefit of the instant disclosure.

Effective Circumference Determined Based on Calculated Film Angle

As noted above, in other embodiments of the invention, the film angle, and thus the effective radius and effective circumference used in a wrap speed model consistent with the invention, may be calculated or derived from other measurements and/or input data.

Figure 10:
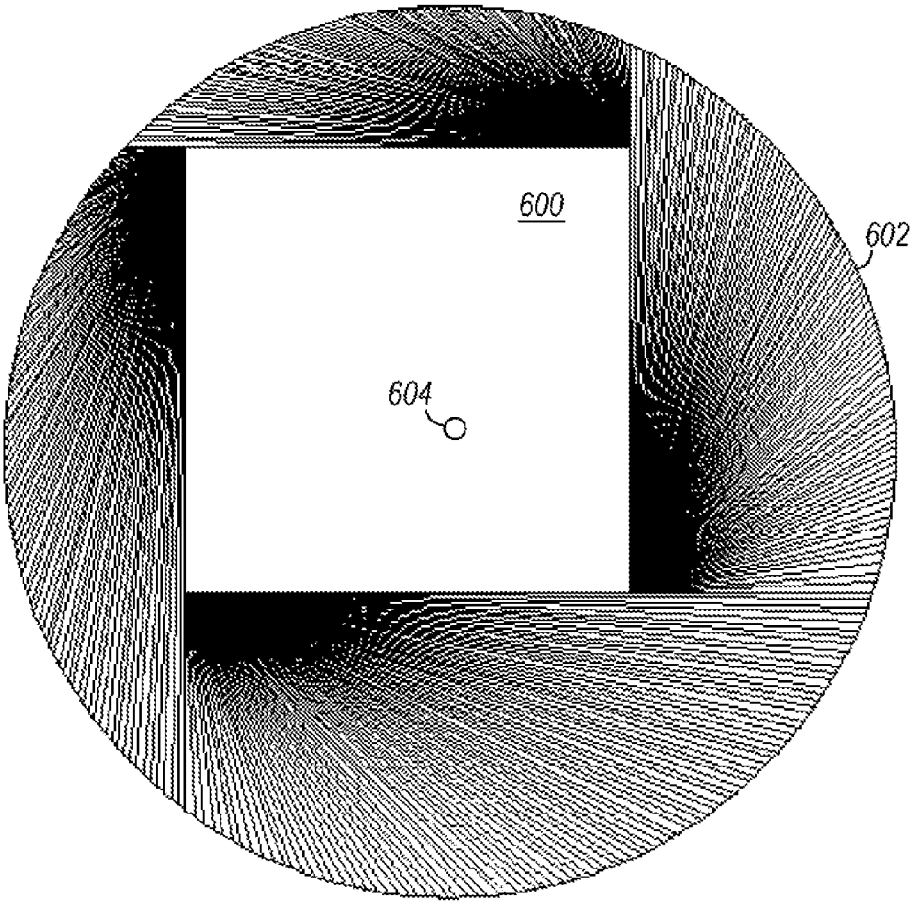
FIG. 10 is a plot of film lengths at a plurality of angles around a rotating load.

FIG. 10, for example, illustrates a representative plot of the length of a web of packaging material from an exit point of a packaging material dispenser to a point of engagement with an example load throughout a full relative rotation between the packaging material dispenser and the load. Put another way, consider a fixed load 600 and a packaging material dispenser that rotates about load 600 with an exit point that traverses a circular path 602 having a center of rotation 604. Each line represents the length of the web of packaging material at a particular angular relationship between the packaging material dispenser and the load, and for the purposes of this example, the load is assumed to be 40×40 inches and offset from the center of rotation.

Figure 11:
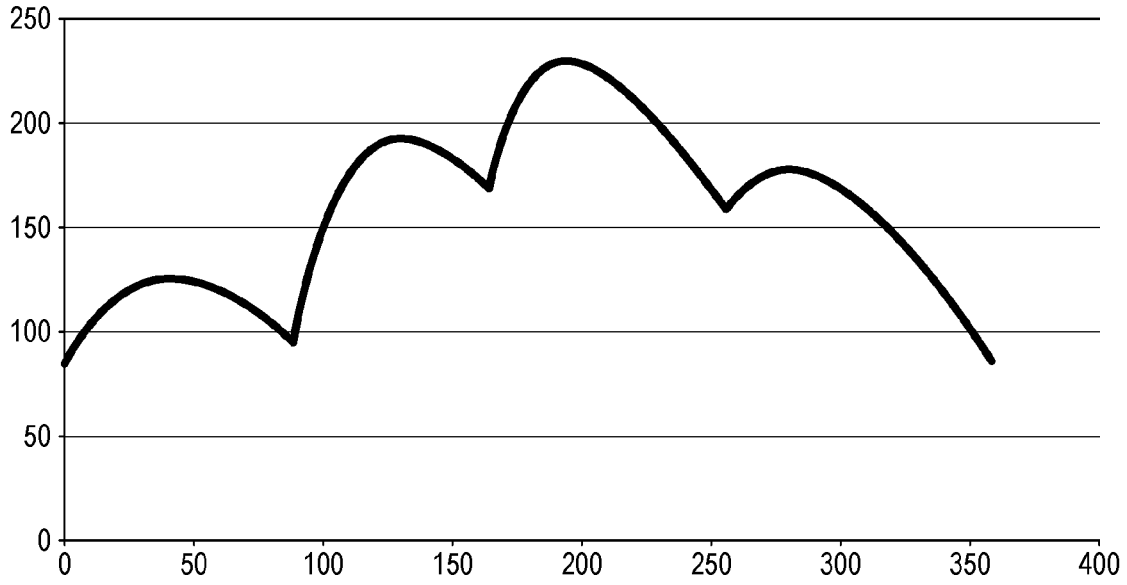
FIG. 11 is a graph of the film lengths plotted in FIG. 10.

FIG. 11, in turn, illustrates a graph of the distances of the lines at a plurality of angles in a full relative rotation of 360 degrees, and it has been found that the graph accurately depicts the effective consumption rate of the load throughout the relative rotation. Moreover, as has been discussed above in connection with equations (1)-(11), the dimensions of the tangent circle (e.g., the effective circumference and the effective radius), the film angle and the film speed are all geometrically related to this effective consumption speed.

Figure 12A:
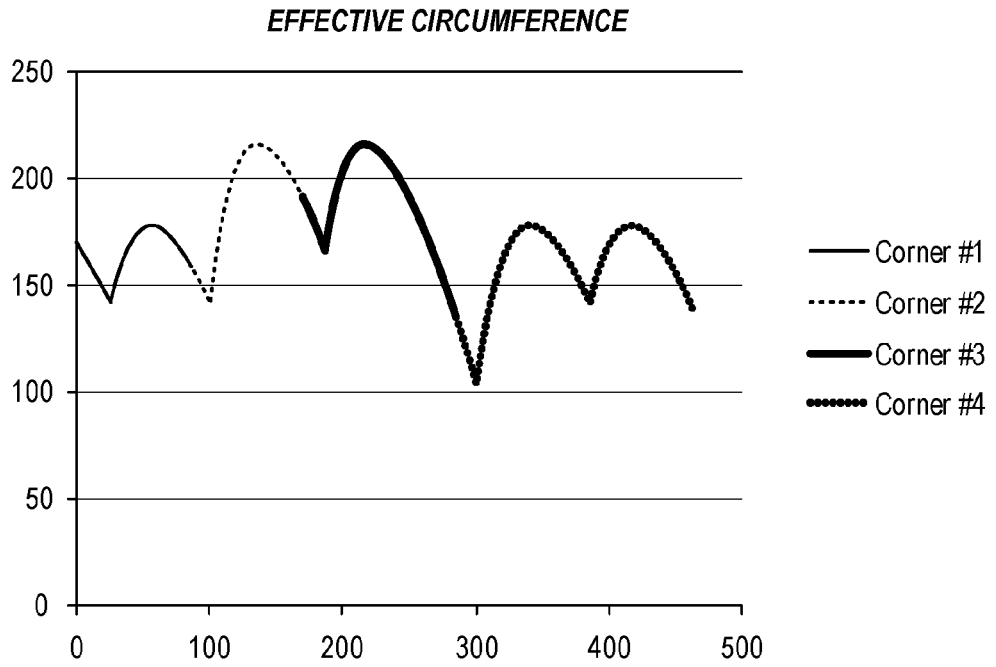
FIGS. 12A, 12B and 12C are respective graphs of effective circumference, film angle and idle roller speed for an example offset load at a plurality of angles of a relative rotation between the load and a packaging material dispenser.
Figure 12B:
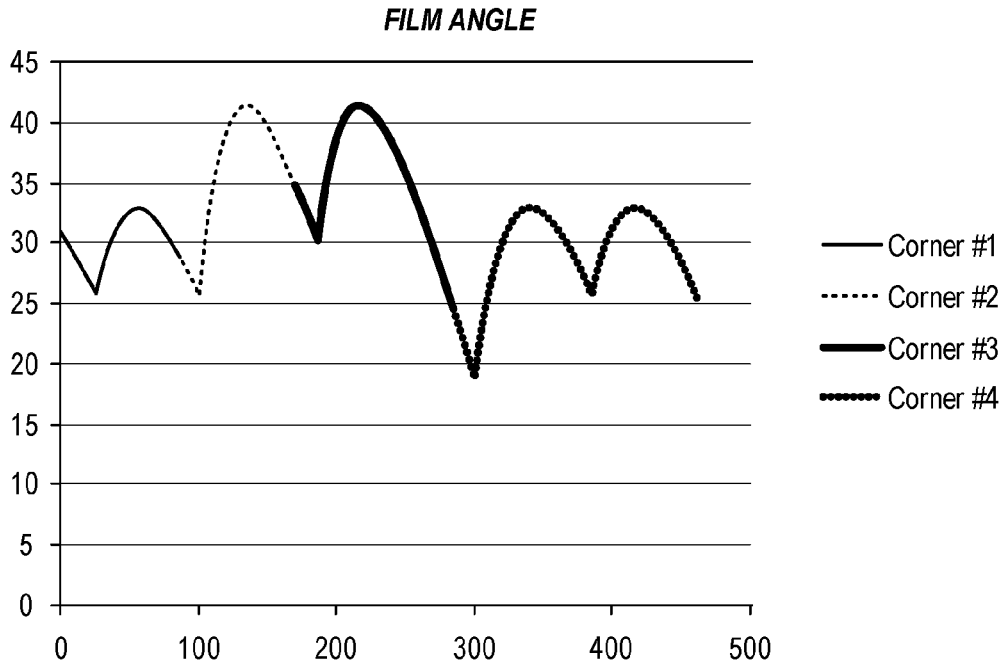
Figure 12C:
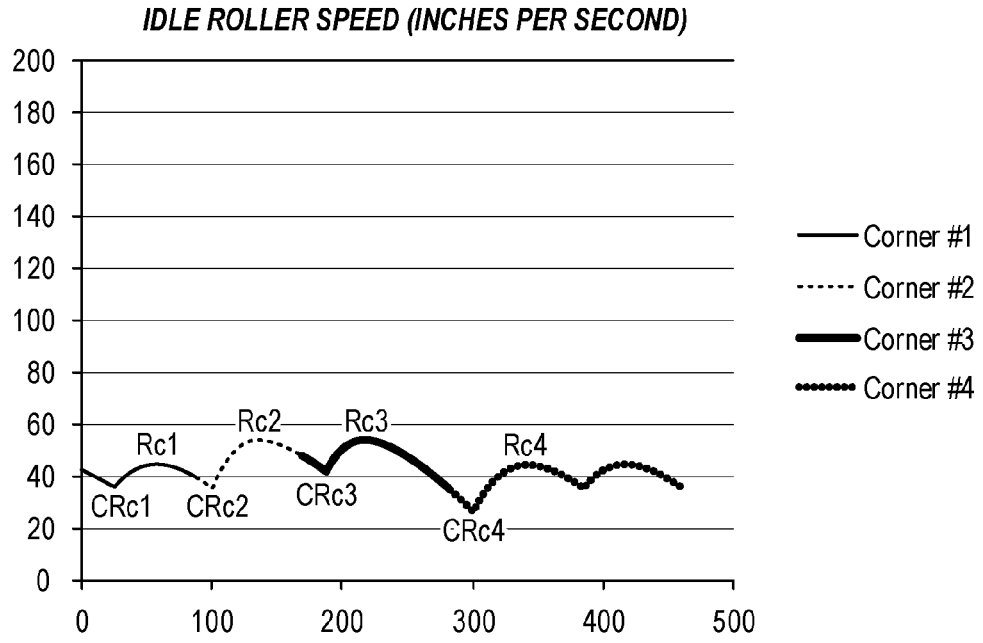

As shown in FIGS. 12A-12C, for example, effective circumference, film angle, and idle roller speed (which is proportional to film speed) are respectively graphed over a plurality of angles for an example load with a 48 inch length, a 40 inch width, and an offset of 4 inches in length and 0 inches in width. It can be seen that all three parameters follow the same general profile (though film speed is both dampened and delayed), and thus, each may be used to control dispense rate to match an effective consumption rate of the load.

Figure 13:
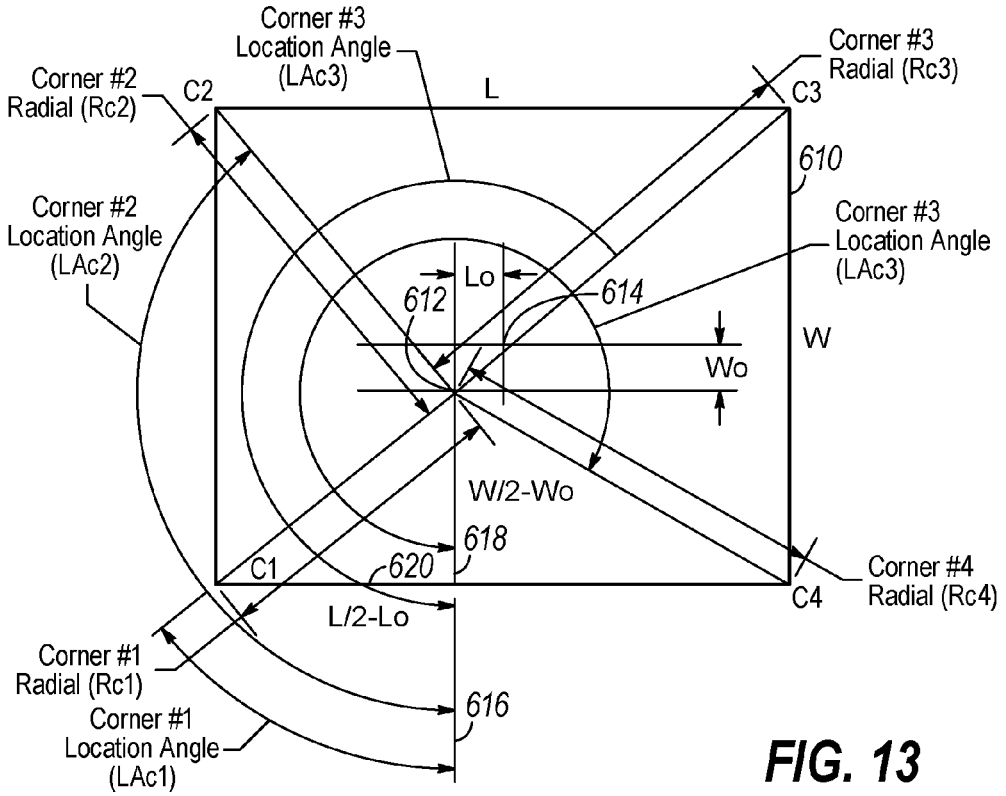
FIGS. 13-14 are block diagrams illustrating various dimensions and angles defined on an example load.

In some embodiments, the effective consumption rate may be determined in part based on the dimensions and offset of the load, which may be determined using the locations of the corners of the load. For example, as shown in FIG. 13, an example load 610 of length L and width W, and having four corners denoted C1, C2, C3 and C4, may be considered to have four corner radials Rc1, Rc2, Rc3 and Rc4 extending from a center of rotation 612 to each respective corner. The load has a geometric center 614 that is offset along the length and width as represented by Lo and Wo.

The location of each corner may be defined, for example, using polar coordinates for each of the corner radials, defining both a length (RcX, where X=1, 2, 3, or 4) and an angle (referred to as a corner location angle, LAcX) relative to a base angular position, such as defined at 616. Alternatively, Cartesian coordinates may be used.

The length and the width of the load may be determined using the corner radial locations, for example, by applying the law of cosines to the triangles formed by the corner radials and the outer dimensions of the load. For example, with the corner radials for corners 1 and 4 known, the length may be determined as follows:

$$L=\sqrt{Rc4^2+Rc1^2-2*Rc4*Rc1*\cos(Ac4c1)} \tag{12}$$

where Ac4c1=360−LAc4+LAc1.

Alternatively, the length may be determined using the corner radials for corners 2 and 3, as follows:

$$L=\sqrt{Rc2^2+Rc3^2-2*Rc2*Rc3*\cos(Ac2c3)} \tag{13}$$

where Ac2c3=LAc3−LAc2.

Similarly, the width of the load may be determined using either the corner radials for corners 3 and 4, or the corner radials for corners 1 and 2:

$$W=\sqrt{Rc3^2+Rc4^2-2*Rc3*Rc4*\cos(Ac3c4)} \tag{14}$$

$$L=\sqrt{Rc1^2+Rc2^2-2*Rc1*Rc2*\cos(Ac1c2)} \tag{15}$$

where Ac3c4=LAc4−LAc3 and Ac1c2=LAc2−LAc1.

Conversely, using Pythagorean's theorem the lengths of the corner radials may be determined from the length L, width W and offset Lo, Wo as follows:

$$Rc1=\sqrt{\left(\frac{W}{2}-Wo\right)^2+\left(\frac{L}{2}-Lo\right)^2} \tag{16}$$

$$Rc2=\sqrt{\left(\frac{W}{2}+Wo\right)^2+\left(\frac{L}{2}-Lo\right)^2} \tag{17}$$

$$Rc3=\sqrt{\left(\frac{W}{2}+Wo\right)^2+\left(\frac{L}{2}+Lo\right)^2} \tag{18}$$

$$Rc1=\sqrt{\left(\frac{W}{2}-Wo\right)^2+\left(\frac{L}{2}+Lo\right)^2} \tag{19}$$

Furthermore, to determine the corner location angle for the corner radials, the orthogonal distances from the center of rotation to the sides of the rectangle may be used to define a right triangle with the corner radial as the hypotenuse. As shown in FIG. 13, for example, for corner radial Rc1, a right triangle is defined between the corner radial and line segments 618, 620. Taking the arcsine of the ratio of segment 620 and the corner radial Rc1 gives the corner location angle LAc1:

$$LAc1=\sin^{-1}\left(\frac{\frac{L}{2}-Lo}{Rc1}\right) \tag{20}$$

Figure 14:
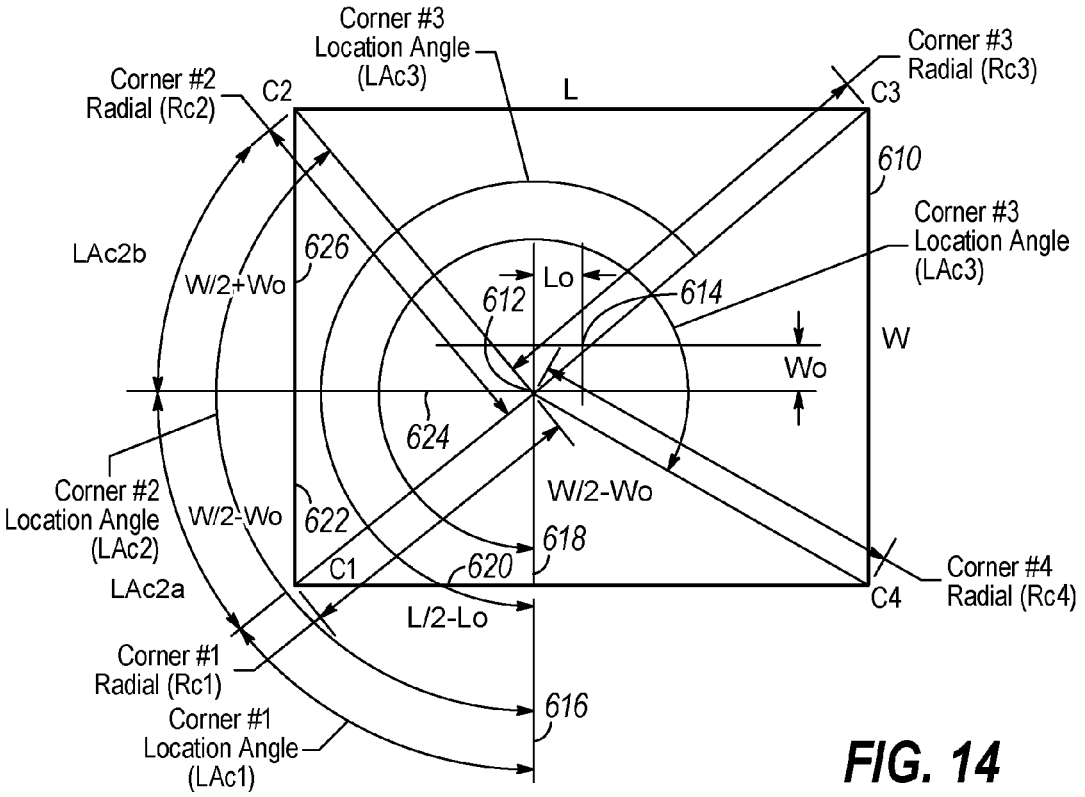

To determine the corner location angle LAc2 for corner radial Rc2, this angle may be considered to include LAc1 summed with the angle defined between corner radials Rc1 and Rc2, which in turn may be considered to be defined by two sub-angles LAc2*a* and LAc2*b*, as shown in FIG. 14, or:

$$LAc2=LAc1+LAc2a+LAc2b \tag{21}$$

LAc2*a* may be determined using a right triangle defined by corner radial Rc1 and line segments 622 and 624, e.g., by taking the arcsine of the ratio of segment 622 and corner radial Rc1:

$$LAc2a = \sin^{-1}\left(\frac{\frac{W}{2} - Wo}{Rc1}\right) \tag{22}$$

LAc2*b* may be determined using a right triangle defined by corner radial Rc2 and line segments 624 and 626, e.g., by taking the arcsine of the ratio of segment 626 and corner radial Rc2:

$$LAc2b = \sin^{-1}\left(\frac{\frac{W}{2} + Wo}{Rc2}\right) \tag{23}$$

For corner location angles LAc3 and LAc4, a similar summation of angles may be performed. Thus, LAc3 =LAc2+LAc3*a*+LAc 3*b*, where:

$$LAc3a = \sin^{-1}\left(\frac{\frac{L}{2} - Lo}{Rc2}\right) \tag{24}$$

$$LAc3b = \sin^{-1}\left(\frac{\frac{L}{2} + Lo}{Rc3}\right) \tag{25}$$

In addition, LAc4=LAc3+LAc4*a*+LAc4 *b*, where:

$$LAc4a = \sin^{-1}\left(\frac{\frac{W}{2} + Wo}{Rc3}\right) \tag{26}$$

$$LAc4b = \sin^{-1}\left(\frac{\frac{W}{2} - Wo}{Rc4}\right) \tag{27}$$

It should be noted that instead of arcsines, arccosines may be used to determine the corner location angles. Alternatively, the corner location angles may be determined without having to first calculate the lengths of the corner radials and/or without having to sum together the angles from preceding corners. As shown in FIG. 13, for example, for corner radial Rc1, a right triangle is defined between the corner radial and line segments 618, 620, which respectively have lengths of W/2-Wo and L/2-Lo. Taking the arctangent of the ratio of these two distances gives the corner location angle LAc1:

$$LAc1 = \tan^{-1}\left(\frac{\frac{L}{2} - Lo}{\frac{W}{2} - Wo}\right) \tag{28}$$

Likewise, for corner radials Rc2, Rc3 and Rc4, the corner location angles may be calculated as follows (since for corner radials Rc2, Rc3 and Rc4, the right triangles analogous to that used to calculate the corner location angle for the corner radial Rc1 are respectively 90, 180 and 270 degrees from base angular position 616):

$$LAc2 = \tan^{-1}\left(\frac{\frac{W}{2} + Wo}{\frac{L}{2} - Lo}\right) + 90 \tag{29}$$

$$LAc3 = \tan^{-1}\left(\frac{\frac{L}{2} + Lo}{\frac{W}{2} + Wo}\right) + 180 \tag{30}$$

$$LAc4 = \tan^{-1}\left(\frac{\frac{W}{2} - Wo}{\frac{L}{2} + Lo}\right) + 270 \tag{31}$$

Figure 15:
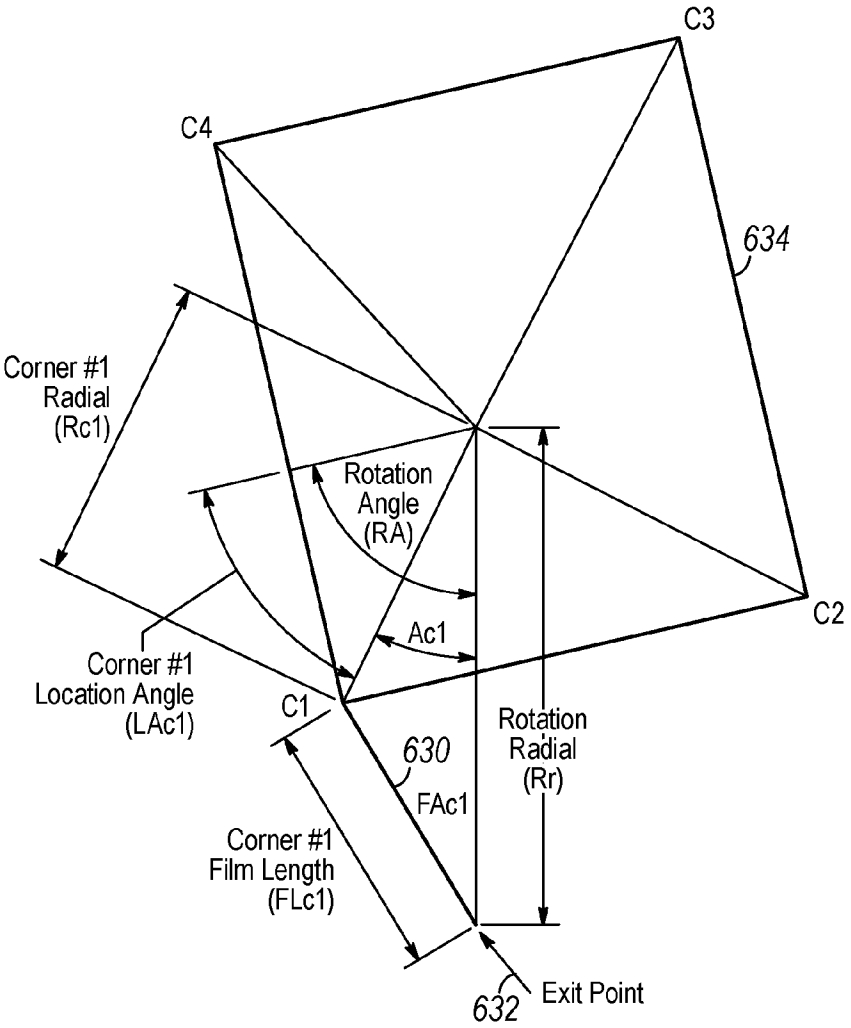

Based on the locations of the corner radials, the film angle at any rotational position of the load may be determined. For example, In one embodiment, the film angle FA may be determined by first determining the length of a web of packaging material, e.g., web 630 of FIG. 15, which extends between an exit point 632 of a packaging material dispenser and corner c1 of a load 634. Of note, in FIG. 15, the load rotates counterclockwise relative to the dispenser.

For the first corner c1, for example, the corner film length FLc1 may be determined using the law of cosines based upon the known rotation angle RA of the load, the corner location angle LAc1 of corner c1, and the lengths Rr and Rc1 of the rotation radial and the corner radial for corner c1, as follows:

$$FLc1=\sqrt{Rc1^2+Rr^2-2*Rc1*Rr*\cos(Ac1)} \tag{32}$$

where Ac1 =RA−LAc1.

Likewise, for corners c2, c3 and c4, the respective corner film lengths FLc2, FLc3 and FLc4 may be calculated as follows:

$$FLc2=\sqrt{Rc2^2+Rr^2-2*Rc2*Rr*\cos(Ac2)} \tag{33}$$

$$FLc3=\sqrt{Rc3^2+Rr^2-2*Rc3*Rr*\cos(Ac3)} \tag{34}$$

$$FLc4=\sqrt{Rc4^2+Rr^2-2*Rc4*Rr*\cos(Ac4)} \tag{35}$$

where Ac2=RA−LAc2, Ac3=RA−LAc4, and Ac4=RA−LAc4.

Upon calculation of the corner film length, the law of cosines may then be used to determine the film angle as follows:

$$FAc1 = \cos^{-1}\left(\frac{FLc1^2 + Rr^2 - Rc1^2}{2 * FLc1 * Rr}\right) \tag{36}$$

For corners c2, c3 and c4, the film angle is likewise calculated as follows:

$$FAc2 = \cos^{-1}\left(\frac{FLc2^2 + Rr^2 - Rc2^2}{2 * FLc2 * Rr}\right) \tag{37}$$

$$FAc3 = \cos^{-1}\left(\frac{FLc3^2 + Rr^2 - Rc3^2}{2 * FLc3 * Rr}\right) \tag{38}$$

$$FAc4 = \cos^{-1}\left(\frac{FLc4^2 + Rr^2 - Rc4^2}{2 * FLc4 * Rr}\right) \tag{39}$$

Once the film angle is known for a given corner, the dimensions of the tangent circle, and thus the effective consumption rate, may be determined, and equation (9) as discussed above may be used to control the dispense rate.

Figure 16:
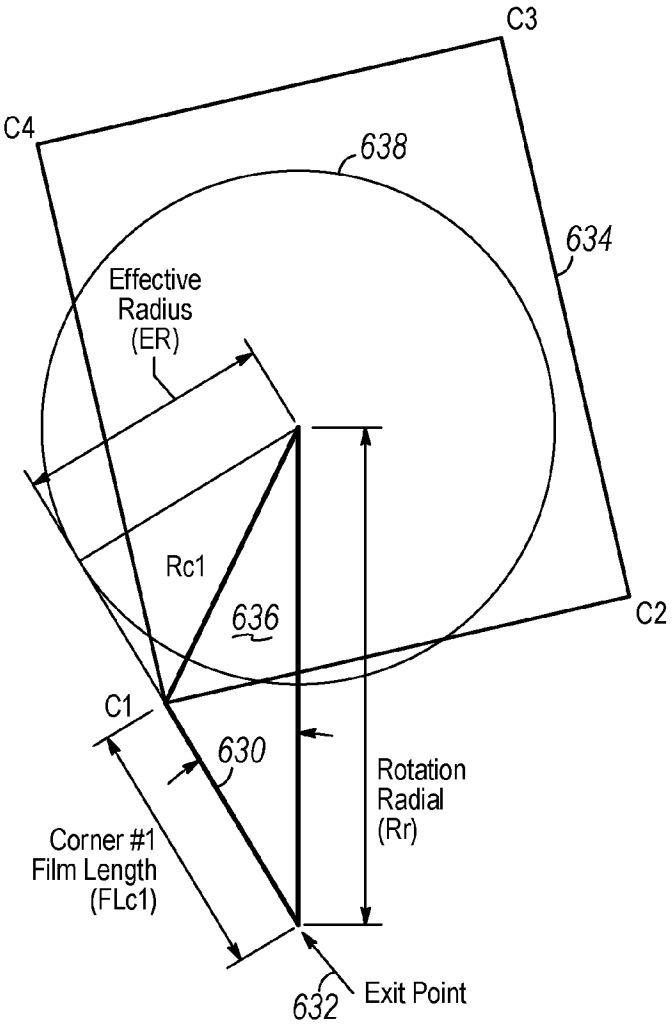
FIGS. 15-17 are block diagrams illustrating various dimensions and angles defined on another example load during a wrapping operation.

It will be appreciated that in some embodiments of the invention, the dimensions of the tangent circle may be determined without one or more of the intermediate calculations discussed above. For example, in some embodiments, film angle does not need to be separately calculated. As shown in FIG. 16, for example, for a given corner, a triangle 636 is defined by the rotation radial, web 630 and the corner radial, each respectively having a length Rr, FLc1 and Rc1. The altitude of this triangle is the effective radius of tangent circle 638. This altitude may be calculated by applying Heron's formula to obtain the area of the triangle, and then deriving the altitude from the area formula for a triangle (area=½*base*altitude), where the base in the area formula corresponds to the film length FLc1:

$$R_{TC} = \frac{2 * \sqrt{s(s - FLc1)(s - Rr)(s - Rc1)}}{FLc1} \tag{40}$$

where s, the semiperimeter, is one half the sum of the sides, or (FLc1 +Rr+Rc1)/2.

It will be appreciated that other trigonometric formulas and rules may be utilized to derive various dimensions and angles utilized herein to determine effective consumption rate without departing from the spirit and scope of the invention.

Load Distance

As noted above, a load distance sensor may be used to determine film angle, and thus, effective circumference and/or effective consumption rate. In one embodiment, for example, a load distance sensor 432, as illustrated in FIG. 5, may be oriented along a radius from the center of rotation 408 and at a known and fixed distance from and angular position about the center of rotation. By orienting this sensor such that a corner passes the sensor prior to engaging the packaging material, both the length and the contact angle of the corner radial may be determined prior to contact with the packaging material, and used to control dispense rate through the phase of the rotation in which the web of packaging material extends between the corner and the exit point of the dispenser. For example, a corner typically may be identified at a local minimum in the output of load distance sensor 432, which occurs when the corner passes the sensor.

Alternatively, the load distance sensor may be used to determine the complete geometric profile of the load, e.g., through an initial full revolution in which the distance to the surface of the load is stored and used to derive the length, width and offset of the load and/or the locations of each of the corners. In addition, given that some loads may have varying dimensions from top to bottom, it may be desirable in some embodiments to record the output of the load distance sensor during each revolution for use in determining the dimensions of the load to be used for the subsequent revolution (or for multiple subsequent revolutions).

Derivation of the corner locations (e.g., corner radials and corner location angles) from the determined dimensions and offset of the load may then be performed in the manner discussed above, such that an effective consumption rate and/or effective circumference/radius-based wrap speed model may be employed to control the dispense rate during a wrapping operation.

Film Speed

Another input that may be used to determine film angle, and thus, effective circumference and/or effective consumption rate, is film speed, e.g., the speed of idle roller 126 as sensed by sensor 150 of FIG. 1 and converted from rotational velocity to linear velocity based on the known radius of the idle roller.

To correlate the film speed to the dimensions of the load, the amplitudes of the local minimums and maximums of the film speed, or alternatively, the local minimums and maximums of the rotational velocity of the idle roller, may be used. In general, the amplitude of the peak, or maximum, speed after a corner passes approximates the length of its corner radial, while the amplitude of the minimum speed where a corner passes approximates the length of its contact radial, which is typically the effective radius of the load at corner contact. The angle where the peak or maximum speed occurs after a corner passes approximates the corner location angle where the length of the corner radial and the effective radius are approximately equal, and the angle where the minimum speed occurs after a corner passes approximates the contact angle for that corner. FIG. 12C, for example, illustrates the points matching the approximate amplitudes and angles corresponding to the corner radials Rc1, Rc2, Rc3 and Rc4 for corners c1, c2, c3 and c4, and to the contact radials CRc1, CRc2, CRc3 and CRc4.

Figure 17:
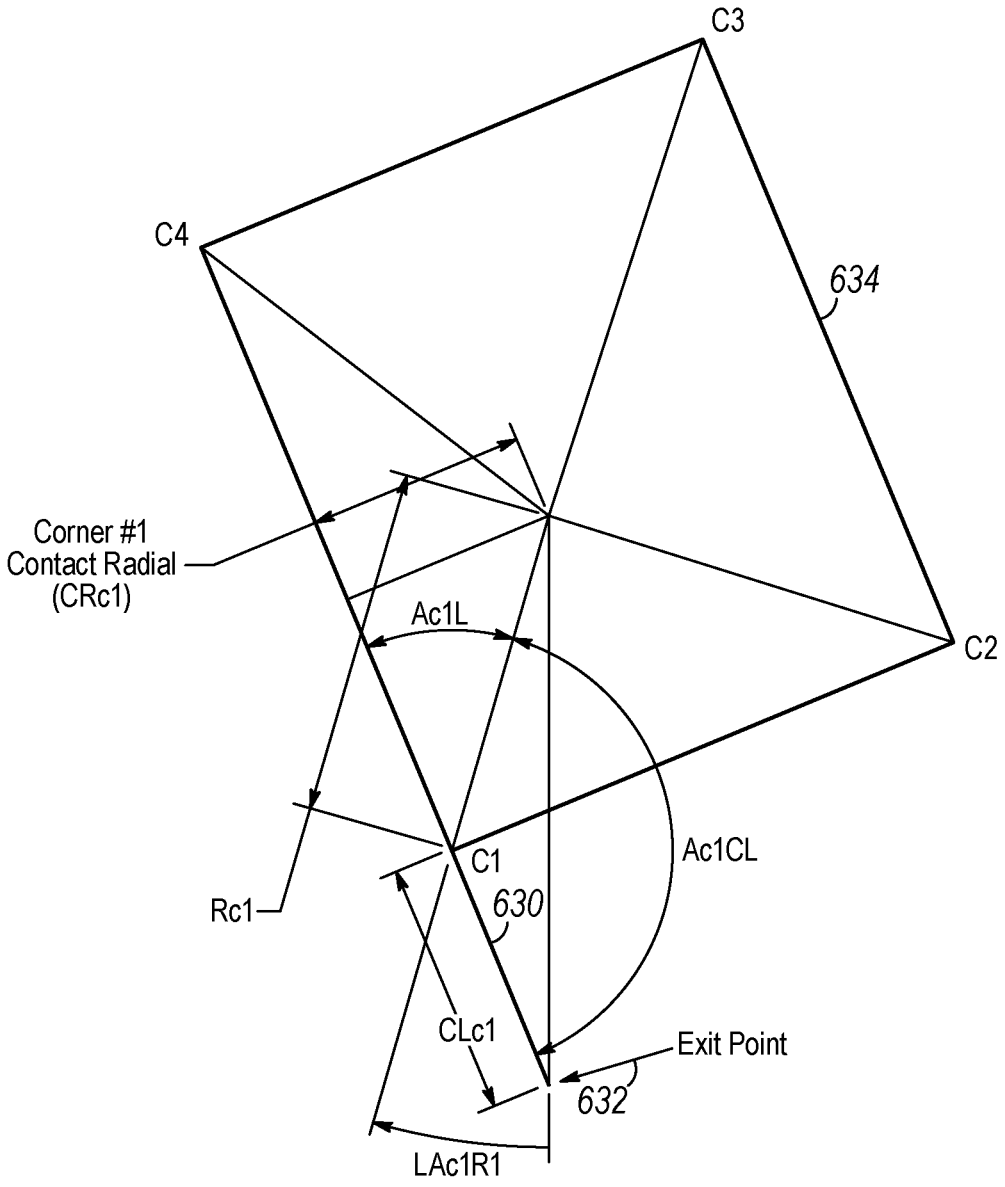

With reference to FIG. 17, for example, the corner radial length (Rc1) and the contact radial length (CRc1) for corner c1 for may be determined as follows:

$$Rc1 = \left(\frac{FS_{max} * K}{2\pi}\right) \tag{41}$$

$$CRc1 = \left(\frac{FS_{min} * K}{2\pi}\right) \tag{42}$$

where $FS_{max}$ is the local maximum film speed after a corner passes, $FS_{min}$ is the local minimum film speed after the corner passes, and K is a constant used to convert film speed units into length/revolution (e.g., if film speed units are in inches/sec, K may be rotation speed in second/revolution). It will be appreciated that K may be determined empirically or may be calculated based upon the dimensions and configuration of the wrapping apparatus and the sensor used to determine the film speed.

In addition, again with reference to FIG. 17, the location of the corner relative to the rotation radial may be determined, for example, as follows:

$$Ac1L = \sin^{-1}\left(\frac{CRc1}{Rc1}\right) \tag{43}$$

$$Ac1CL = 180 - Ac1L \tag{44}$$

$$CLc1 = Rc1 * \cos(Ac1CL) + \sqrt{Rr^2 - Rc1^2 * \sin^2(Ac1CL)} \tag{45}$$

$$LAc1Rr = \sin^{-1}\left(\frac{CLc1 * \sin(Ac1CL)}{Rr}\right) \tag{46}$$

where Lac1 Rr is the difference between the corner location and corner contact angles for the corner.

Calculation of the corresponding values for corners c2, c3 and c4 are performed in a similar manner. Derivation of the dimensions and offset of the load from these values may be performed in the manner discussed above, and an effective consumption rate and/or effective circumference/radius-based wrap speed model may be employed to control the dispense rate during a wrapping operation based upon these values.

Load Dimensions

Yet another input that may be used to determine film angle, and thus, effective circumference and/or effective consumption rate, is the measured or input dimensions of the load. In some embodiments, for example, the dimensions and/or offset may be manually input by an operator through a user interface with a wrapping apparatus. In an alternate embodiment, the dimensions and/or offset may be stored in a database and retrieved by the controller of the wrapping apparatus. In some embodiments, for example, where a conveyor is used to convey loads to and from the wrapping apparatus, upstream machinery may provide dimensions of the load to the wrapping apparatus prior to arrival, or a bar code or other identification may be provided on the load to be read by the wrapping apparatus and thereby enable retrieval of the dimensions based on the identification.

In still other embodiments, a light curtain or other dimensional sensor or sensor array may be used to visually determine the dimensions and/or offset of the load. The dimensions and offset may be determined, for example, before the load is conveyed to the wrapping apparatus, or alternatively, after the load has been conveyed to the wrapping apparatus, and prior to or during initiation of a wrapping operation for the load.

Derivation of the corner locations (e.g., corner radials and corner location angles) from the determined dimensions and offset of the load may then be performed in the manner discussed above, such that an effective consumption rate and/or effective circumference/radius-based wrap speed model may be employed to control the dispense rate during a wrapping operation.

Corner Rotation Angle-Based Wrapping

In some embodiments of the invention, a wrap speed model and wrap speed control utilizing such a wrap speed model may be based at least in part on rotation angles associated with one or more corners of a load. In this regard, a corner rotation angle may be considered to include an angle or rotational position about a center of rotation that is relative to or otherwise associated with a particular corner of a load. In some embodiments, for example, a corner rotation angle may be based on a corner location angle for a corner, and represent the angular position of a corner radial relative to a particular base or home position. Alternatively, a corner rotation angle may be based on a corner contact angle for an angle, representing an angle at which packaging material first comes into contact with a corner during relative rotation between the load and a packaging material dispenser. Given that these and other angles are geometrically related to one another based on the geometry of the load, it will be appreciated that a corner rotation angle consistent with the invention is not limited to only a corner location angle or a corner contact angle, and that other angles relative to or otherwise associated with a corner may be used in the alternative.

As will become more apparent below, corner rotation angles may be used in connection with wrap speed control in a number of manners consistent with the invention. For example, in some embodiments corner rotation angles may be used to determine to what corner the packaging material is currently engaging, and thus, what corner is driving the effective consumption rate of the load. In this regard, in some embodiments, multiple corners may be tracked to enable a determination to be made as to when to switch from a current corner to a next corner when controlling dispense rate. In other embodiments, corner rotation angles may be used to anticipate corner contacts and perform controlled interventions, and in still other embodiments, corner rotation angles may be used in the performance of rotational data shifts.

In some embodiments of the invention, for example, it may be desirable to determine and/or predict or anticipate a rotation angle such as a contact angle of each corner of a load during the relative rotation. In some embodiments, a contact angle, representing the rotational position of the load when the packaging material first contacts a particular corner, may be determined for each corner.

The contact angles may be sensed using various sensors discussed above, or determined via calculation based on the dimensions/offset of the load and/or corner locations. In addition, the contact angles may be used to effectively determine what corner is driving the wrap speed model, and thus, what corner profile should be used to control dispense rate.

Figure 18:
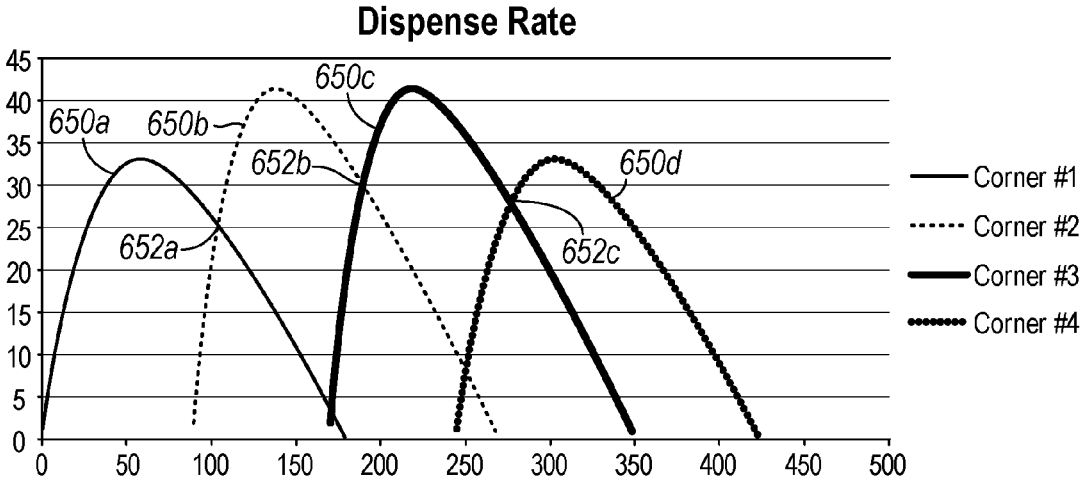
FIG. 18 is a graph of dispense rates for four corners of a load.

FIG. 18, for example, illustrates a graph of the ideal dispense rates for corner profiles 650*a*, 650*b*, 650*c* and 650*d* for the four corners of the same load depicted in FIGS. 12A-12C. It should be noted that the intersections of these profiles, at 652*a*, 652*b* and 652*c*, represent the contact angles when the packaging material, which is being driven by one corner, contacts the next corner such that the next corner begins to drive the desired dispense rate of the packaging material. Comparing FIG. 18 to FIGS. 12A-12B it may be seen that the effective circumference and film angle track these profiles and contact angles, and as such, in some embodiments, the contact angles may be sensed using a number of the aforementioned sensors.

For example, each of a film angle sensor and a load distance sensor will reach a local minimum proximate each contact angle. Thus, a wrap speed control may be configured to switch from one corner to a next corner based on the anticipated rotational position of each corner as sensed in either of these manners. As another example, an effective radius or effective circumference may be calculated based upon a current corner and a next corner, such that the contact angle is determined at the angle where the effective radius/effective circumference of the next corner becomes larger than that of the current corner.

Figure 19A:
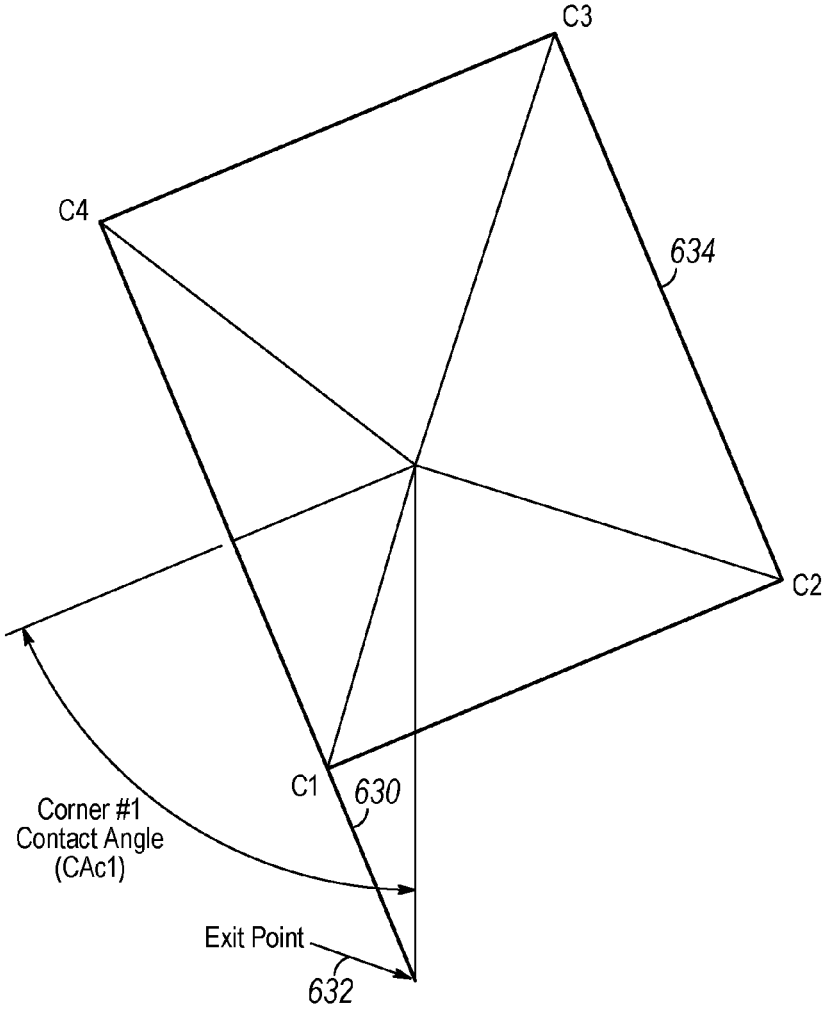
FIGS. 19A-19E are block diagrams illustrating various dimensions and angles defined on another example load during a wrapping operation and used to determine a contact angle for a corner.

Alternatively, the contact angles may be calculated based on the dimensions of the load. As shown in FIG. 19A, for example, the contact angle (CAc1) for corner c1 represents the angle where corner c1 intersects the plane between the previous corner c4 and exit point 632. The contact angle may be calculated, for example, using the length and location angles of the corner radials for the corner at issue and the immediately preceding corner in the rotation (here, Rc1, Rc4, LAc1 and LAc4) and the length of the rotation radial (Rr), which are illustrated in FIG. 19B.

Figure 19C:
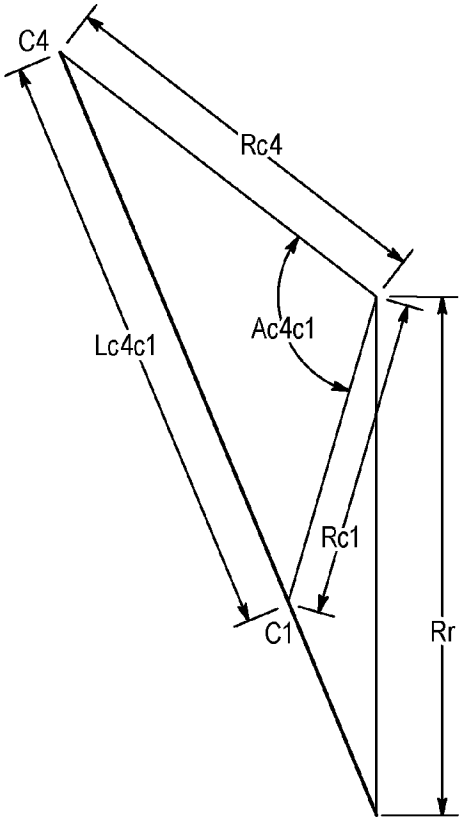
Figure 19B:
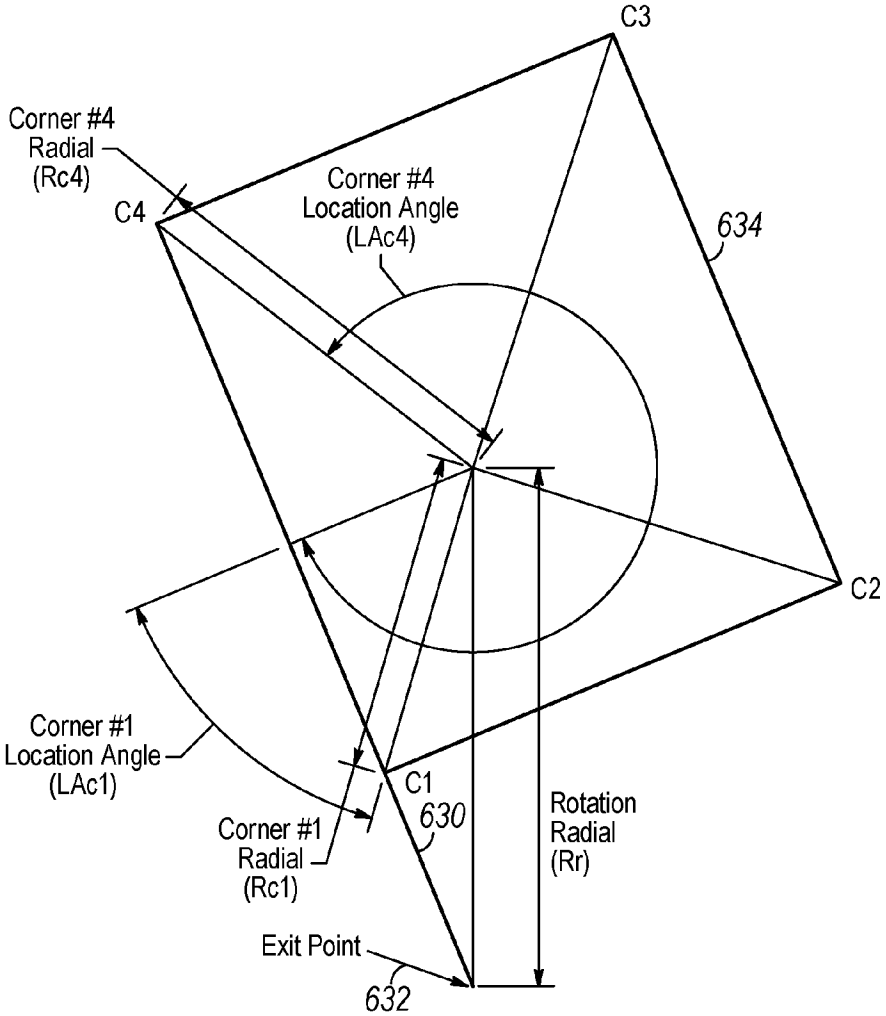

FIG. 19C illustrates two values, Ac4 c1 and Lc4 c1, that may be calculated from the aforementioned values. Ac4 c1 is the angle between the corner location angles for corners c1 and c4:

$$Ac4c1=360-LAc4+LAc1 \tag{41}$$

Lc4c1 is the distance between the corners, which in this instance is equal to the length of the load:

$$Lc4c1=\sqrt{Rc4^2+Rc1^2-2*Rc4*Rc1*\cos(Ac4c1)} \tag{42}$$

Figure 19E:
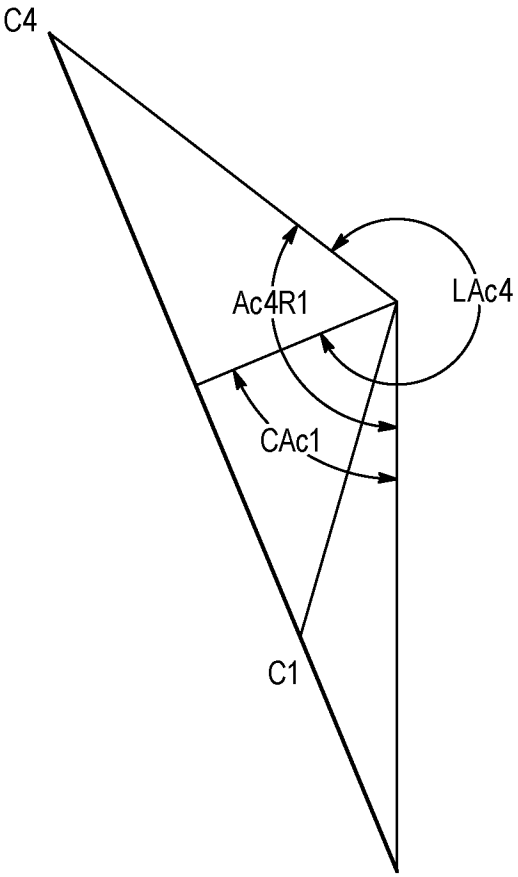
Figure 19D:
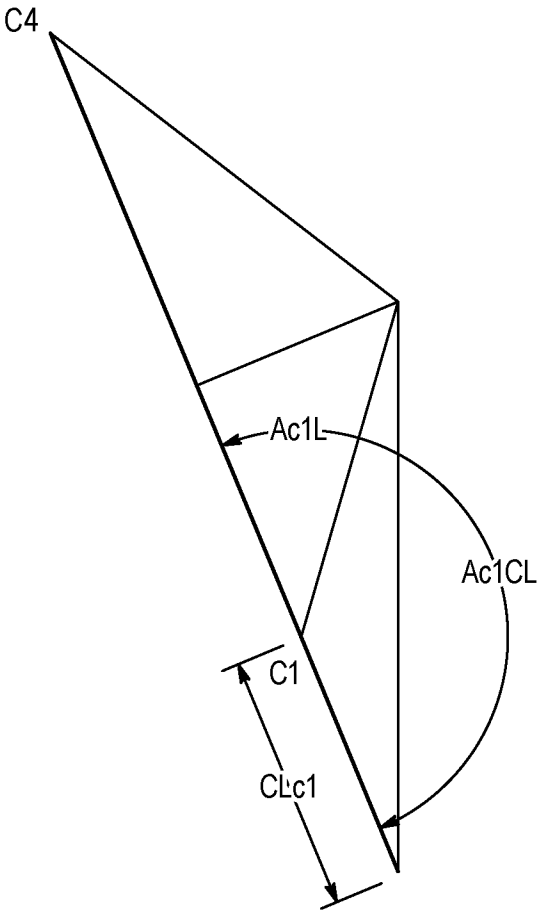

Next, as shown in FIG. 19D, three additional values, illustrated at Ac1 L, Ac1 CL and CLc1, may be calculated as follows:

$$Ac1L = \mathrm{COS}^{-1}\left(\frac{Rc1^2 + Lc4c1^2 - Rc4^2}{2 * Rc1 * Lc4c1}\right) \tag{43}$$

$$Ac1CL = 180 - Ac1L \tag{44}$$

$$CLc1 = Rc1 * \cos(Ac1CL) + \sqrt{Rr^2 - Rc1^2 * \sin^2(Ac1CL)} \tag{45}$$

Next, as shown in FIG. 19E, the contact angle CAc1 for corner c1 may be isolated from the known and calculated angles:

$$Ac4Rr = \mathrm{COS}^{-1}\left(\frac{Rc4^2 + Rr^2 - (CLc1 + Lc4c1)^2}{2 * Rc4 * Rr}\right) \tag{46}$$

$$CAc1 = LAc4 + Ac4Rr - 360 \tag{47}$$

For corners c2, c3 and c4 , a similar analysis may be performed, except that since the location angle preceding corner will be smaller than the current corner (unlike the case with corner c1, where corner c4 has a larger location angle), the determination of the angle between the current and preceding corners in equation (41), and the determination of the contact angle in equation (47), do not need to take into account negative angles. Thus, for example, for corner c2:

$$Ac1c2 = LAc2 - LAc1 \tag{48}$$

$$CAc2 = LAc1 + Ac1Rr \tag{49}$$

The other calculations discussed above for equations (42)-(46), however, are essentially the same.

The contact angle of each corner may therefore be determined and used to select which corner is currently "driving" the dispensing process, based upon the known angular relationship of the load to the packaging material dispenser at any given time. In addition, the contact angle may be used to anticipate a contact of the packaging material with a corner so that, for example, a controlled intervention may be performed.

Wrapping Operation

Returning briefly to FIG. 6, implementation of a wrap speed model 500 using any of the aforementioned techniques may be used to wrap packaging material around a load during relative rotation between the load and a packaging material dispenser. During a typical wrapping operation, a clamping device, e.g., as known in the art, is used to position a leading edge of the packaging material on the load such that when relative rotation between the load and the packaging material dispenser is initiated, the packaging material will be dispensed from the packaging material dispenser and wrapped around the load. In addition, where prestretching is used, the packaging material is stretched prior to being conveyed to the load. Thereafter, wrapping continues while a lift assembly controls the height of the packaging material so that the packaging material is wrapped in a spiral manner around the load from the base of the load to the top. Multiple layers of packaging material may be wrapped around the load over multiple passes to increase containment force, and once the desired amount of packaging material is dispensed, the packaging material is severed to complete the wrap.

Based upon the various techniques discussed above, the manner in which the dispense rate is controlled during this operation may vary in different embodiments. For example, in some embodiments, an initial revolution may be performed to determine the dimensions of the load, such that corner locations may be determined prior to wrapping and then wrapping may commence using these predetermine corner locations to drive the dispenser rate based on a calculated effective consumption rate. In other embodiments, no initial revolution may be performed, and either dimensions of the load as input or retrieved from a database may be used to drive the dispenser rate based on the effective consumption rate. In still other embodiments, sensed film angle, sensed film speed, sensed load distance, etc. may be used to calculate effective consumption rate as soon as wrapping is commenced.

Furthermore, as noted above, some loads may not have a consistent length and width from top to bottom. Loads may include different layers of objects or containers having different lengths and/or widths, and some layers may be offset relative to other layers. As such, it may be desirable in some embodiments to recalculate load dimensions and/or corner locations for different elevations on a load. For example, in some embodiments, as each corner approaches and/or passes the packaging material dispenser, the location of the corner may be recalculated and used for the next pass of the same corner. In some embodiments, load dimensions calculated during one full revolution may be used for the next full revolution, such that as the lift assembly changes the elevation of the packaging material dispenser, the load dimensions are dynamically updated based on the dimensions sensed at a particular elevation of the packaging material dispenser.

Figure 20:
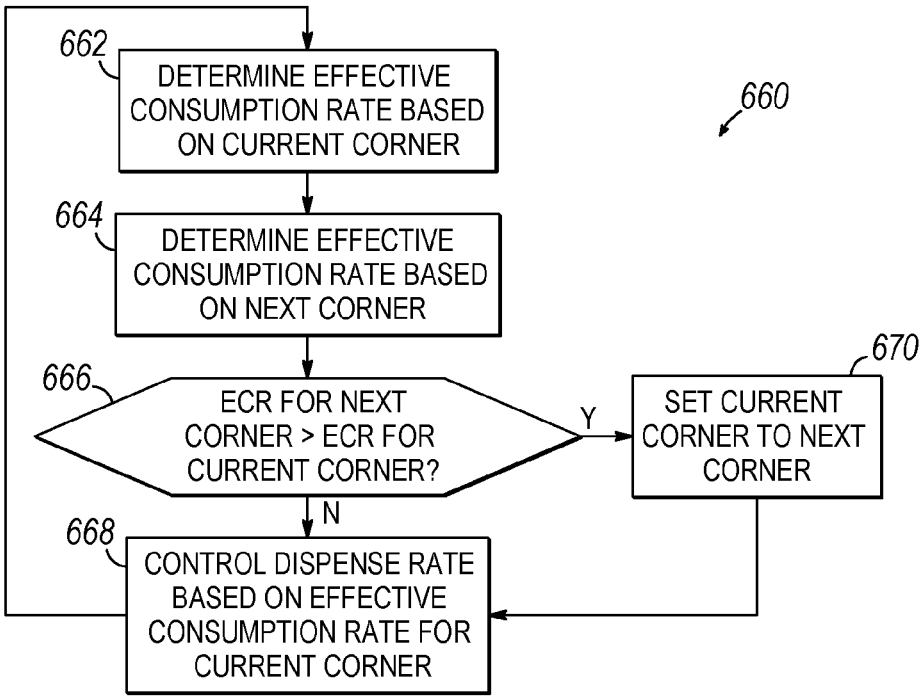
FIG. 20 is a flowchart illustrating an example sequence of steps performed by an effective consumption rate-based wrapping operation consistent with the invention.

One example wrap speed control process 660, which is based on concurrent tracking of multiple corner locations, is shown in FIG. 20. In this process, two corners are effectively tracked at all times. The first is referred to herein as the "current corner," which is the corner that is currently driving the dispensing process, in terms of being the corner at which the packaging material is engaging the load. The second is referred to herein as the "next corner," which is the immediately subsequent corner that will engage the load after further revolution of the load relative to the packaging material dispenser. These corners are concurrently tracked such that each contact between the packaging material and a new corner can be anticipated or detected, thereby allowing the dispense rate to be controlled appropriately based upon the location of the new corner.

One manner of anticipating or detecting a corner contact is based on applying a wrap speed model based on the locations of two corners, and comparing the results. Thus, in blocks 662 and 664, the effective consumption rate is determined based on the location of the current corner and based on the location of the next corner. A corner contact occurs when the effective consumption rate based on the next corner exceeds that of the current corner, as discussed above in connection with FIG. 18, and as such, block 666 compares these two effective consumption rates. So long as the corner contact has not yet occurred, and the effective consumption rate of the current corner is used to control the dispense rate, block 666 passes control to block 668 to control the dispense rate based on the effective consumption rate for the current corner. Control then returns to block 662 to continue tracking the current and next corners.

If, however, the effective consumption rate based on the next corner exceeds that of the current corner, a corner contact has occurred, and block 666 passes control to block 670 to update the current corner to what was previously the next corner. Thus, for example, if the current corner is corner c1 and the next corner is c2, and the effective consumption rate based on corner c2 exceeds that calculated based on corner c1, c2 becomes the new current corner, and consequently, corner c3 becomes the new next corner. Control then passes to block 668 to control the dispense rate based on the new current corner.

As noted above in connection with FIG. 18, the effective circumference, effective radius, film angle, and film speed all track the effective consumption rate. As such, blocks 662, 664 and 666 may alternatively track the corners based on calculating any of these values and compare the results to determine a corner contact.

Figure 21:
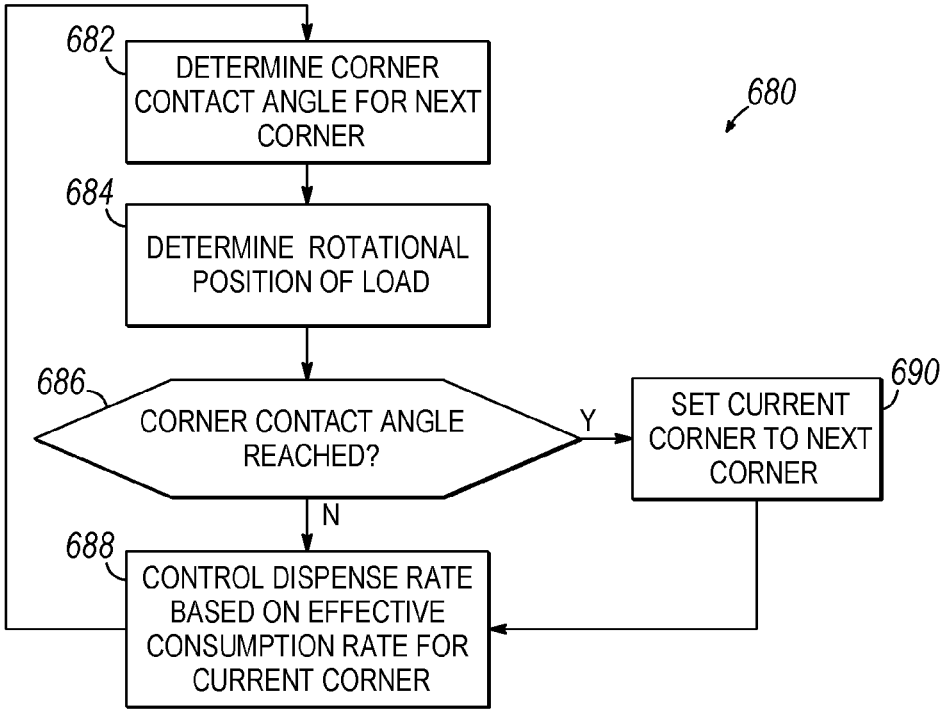
FIG. 21 is a flowchart illustrating an example sequence of steps performed by a corner location angle-based wrapping operation consistent with the invention.

Alternatively, as illustrated by process 680 of FIG. 21, a wrap speed control process may be performed by tracking the corner contact angle for a next corner in block 682, determining the current rotational position of the load in block 684 (e.g., using an angle sensor such as angle sensor 152 of FIG. 1), and then determining in block 686 whether the corner contact angle for the next corner has been reached (i.e., where the rotational position of the load matches the corner contact angle). So long as the corner contact has not yet occurred, block 686 passes control to block 688 to control the dispense rate based on the effective consumption rate calculated from the location of the current corner, and control returns to block 682. Otherwise, if contact has occurred, block 686 passes control to block 690 to set the current corner to the next corner, such that when control is passed to block 688, the next corner, now the new current corner, is used to determine the dispense rate.

Controlled Interventions

It will be appreciated that, even when a desired wrap speed model may be determined for a load, various system lags typically exist in any wrapping apparatus that can make it difficult to match the desired wrap speed. From an electronic standpoint, delays due to the response times of sensors and drive motors, communication delays, and computational delays in a controller will necessarily introduce some amount of lag. Moreover, from a physical or mechanical standpoint, sensors may have delays in determining a sensed value and drive motors, such as the motor(s) used to drive a packaging dispenser, as well as the other rotating components in the packaging material, typically have rotational inertia to overcome whenever the dispense rate is changed. Furthermore, packaging material typically has some degree of elasticity even after prestretching, so some lag will exist before changes in dispense rate propagate through the web of packaging material. In addition, mechanical sources of fluctuation, such as film slippage on idle rollers, out of round rollers and bearings, imperfect mechanical linkages, flywheel effects of downstream non-driven rollers, also exist.

As a result of many of these issues, it may be desirable to implement controlled interventions in some embodiments. Within the context of the invention, an intervention is an operation that controls the dispense rate in a predetermined manner based on a predetermined intervention criteria. In some embodiments, an intervention is an operation that modifies the dispense rate relative to a predicted demand or a dispense rate that has been calculated by a particular wrap model, e.g., a wrap speed model based on effective circumference or effective consumption rate. An intervention may also be an operation that modifies the dispense rate relative to another type of wrap model and/or a wrap model based on another type of control input, e.g., a wrap force model based on wrap force or packaging material tension as monitored by a load cell.

Figure 22:
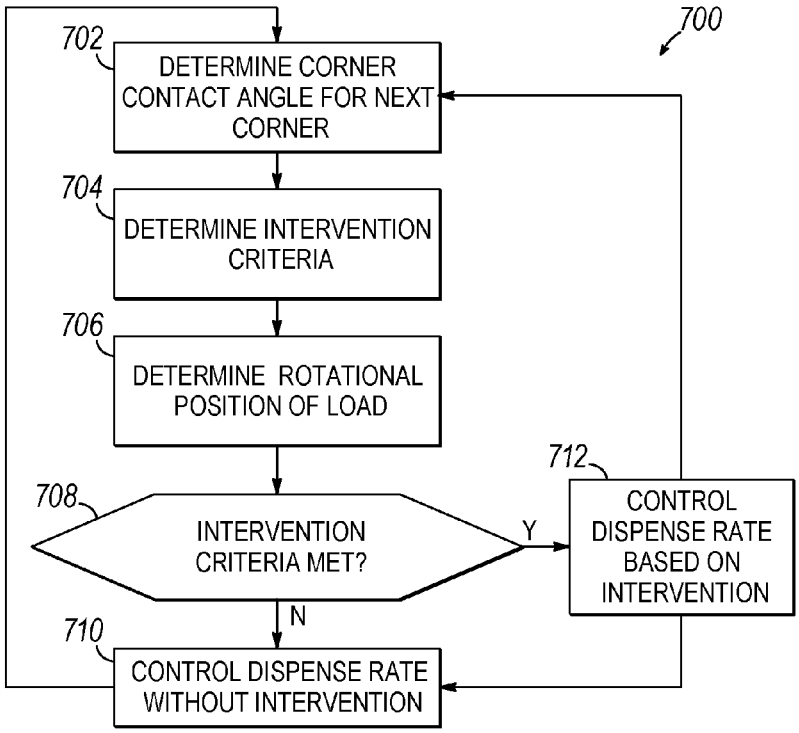
FIG. 22 is a flowchart illustrating an example sequence of steps performed by a wrapping operation implementing controlled interventions in a manner consistent with the invention.

For example, FIG. 22 illustrates an example process 700 that selectively applies one or more controlled interventions at predetermined times or rotational positions relative to a corner contact. In this process, a corner contact angle for a next corner is determined, e.g., predicted or anticipated (block 702) and one or more intervention criteria are determined (block 704). An intervention criteria may include, for example, an absolute rotational position (e.g., at 75 degrees) or a relative rotational position (e.g., 10 degrees before or after corner contact), and may be relative to a corner contact angle, a corner location angle, or another calculated angle. Alternatively, an intervention criteria may be based on absolute or relative times or distances (e.g., 100 ms before or after corner contact). In some embodiments, separate start and end criteria may be specified (e.g., start 10 degrees before corner contact and stop at contact), while in other embodiments, a start criteria may be coupled with a duration such that an intervention is applied for a fixed duration of angles, times or distances after being initiated.

Next, in block 706, the rotational position of the load is determined, e.g., in terms of an angle, a time or distance within a revolution of the load relative to the packaging material dispenser. Block 708 then determines whether an intervention criteria has been met. If not, block 708 passes control to block 710 to control the dispense rate without the use of an intervention, e.g., in any of the manners discussed above based on effective circumference or effective consumption rate. If the criteria for an intervention is met, however, block 708 passes control to block 712 to instead control dispense rate based on the intervention.

Figure 23A:
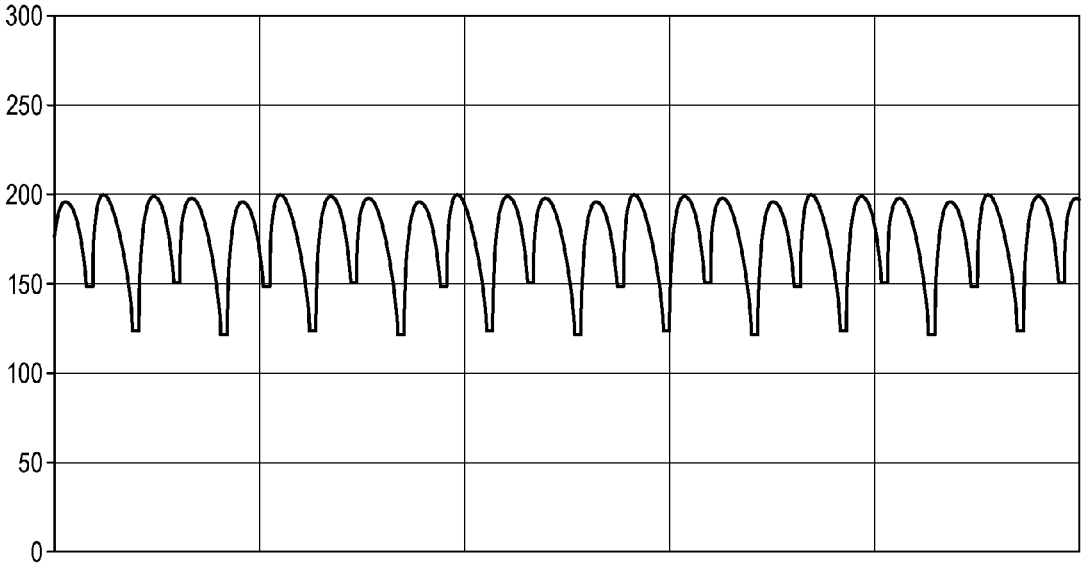
FIGS. 23A-23C are graphs of example controlled interventions capable of being implemented by the wrapping operation of FIG. 22.
Figure 23B:
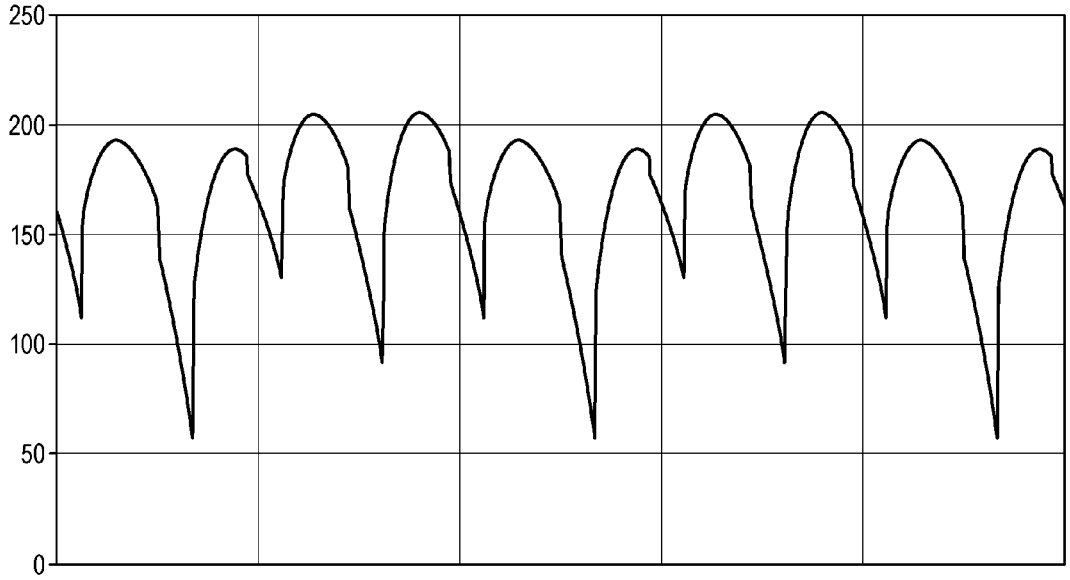

It will be appreciated that in different embodiments, a number of interventions may be performed. For example, it may be desirable to reduce the dispense rate below a predicted demand as calculated by a wrap speed model a few degrees prior to a corner contact to build wrap force as the corner approaches, e.g., as shown in FIG. 23A. In some embodiments, for example, the dispense rate may be advanced a few degrees so that the wrap speed model is time shifted to decrease the dispense rate sooner than would otherwise be performed. In other embodiments, the dispense rate may be set to the dispense rate to be used at the corner contact, only a few degrees early. In still other embodiments, the wrap speed model may be scaled such that the dispense rate is decreased by a certain percentage from that of the wrap speed model as the corner approaches, e.g., as shown in FIG. 23B.

Likewise, it may also be desirable to increase the dispense rate above a predicted demand as calculated by a wrap speed model a few degrees after a corner contact to allow the peak force after the corner to be reduced. Similar to prior to the corner contact, the wrap speed model may be delayed a few degrees or scaled to otherwise increase the dispense rate above that calculated from the wrap speed model. In other embodiments, the dispense rate may be set to hold the dispense rate used at the corner contact for a few extra degrees. It may also be desirable in some embodiments to contact a corner at dispense rate that is a factor less than the dispense rate calculated from the wrap speed model to create a force spike at the corner contact.

Figure 23C:
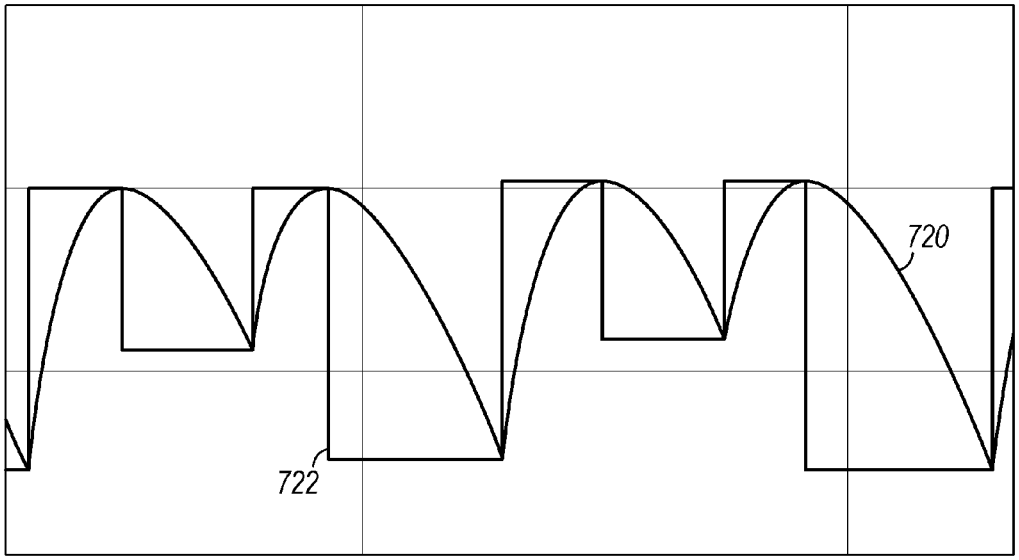

As another alternative, as shown in FIG. 23C, it may be desirable to step between minimum and maximum dispense rates calculated based on a wrap speed model at predetermined times relative to the corners. The dispense rate calculated from an example wrap speed model is illustrated at 720, and as shown at 722, interventions may be applied to essentially switch between the maximum calculated dispense rate for a corner at or a few degrees after the contact with that corner, and then switch to the minimum calculated dispense rate for that corner a few degrees after the peak has passed.

In general an intervention may be used to effectively modify a wrap speed model to improve performance, e.g., by improving containment force and/or reducing the risk of breakage. In many instances, some interventions may be selected to increase force immediately prior to a corner and increase containment force, while other interventions may be selected to relieve force immediately after a corner contact to reduce breakage risk and otherwise ensure that wrap forces built up in the corner are not wasted after the corner contact has occurred. It will be appreciated that multiple interventions may be applied or combined, and that different interventions may be applied to different corners or at different times in the wrapping operation, and that interventions may be tailored for particular corners based on the dimensions of the load. In addition, it will be appreciated that interventions may be applied to wrap models other than effective circumference-based wrap speed models, e.g., wrap force models.

Rotational Data Shift

In addition to or in lieu of a controlled intervention, it may also be desired to account for system lags through the use of a rotational shift of the data utilized by a wrap speed model. As discussed above, electrical and physical delays in sensors, drive motors, control circuitry and even the packaging material necessarily introduce a system lag, such that a desired dispense rate at a particular rotational position of the load, as calculated by a wrap speed model, will not occur at the load until after some duration of time or further angular rotation.

To address this issue, a rotational shift typically may be applied to the sensed data used by the wrap speed model or to the calculated dimensions or position of the load, which in either case has the net effect of advancing the wrap speed model to an earlier point in time or rotational position such that the actual dispense rate at the load will more closely line up with that calculated by the wrap speed model, thereby aligning the phase of the profile of the actual dispense rate with that of the desired dispense rate calculated by the wrap speed model.

In some embodiments, the system lag from which the rotational shift may be calculated may be a fixed value determined empirically for a particular wrapping apparatus. In other embodiments, the system lag may have both fixed and variable components, and as such, may be derived based upon one or more operating conditions of the wrapping apparatus. For example, a controller will typically have a fairly repeatable electronic delay associated with computational and communication costs, which may be assumed in many instances to be a fixed delay. In contrast, the rotational inertia of packaging material dispenser components, different packaging material thicknesses and compositions, and the wrapping speed (e.g., in terms of revolutions per minute of the load) may contribute variable delays depending upon the current operating condition of a wrapping apparatus. As such, in some embodiments, the system lag may be empirically determined or may be calculated as a function of one or more operating characteristics.

Figure 24A:
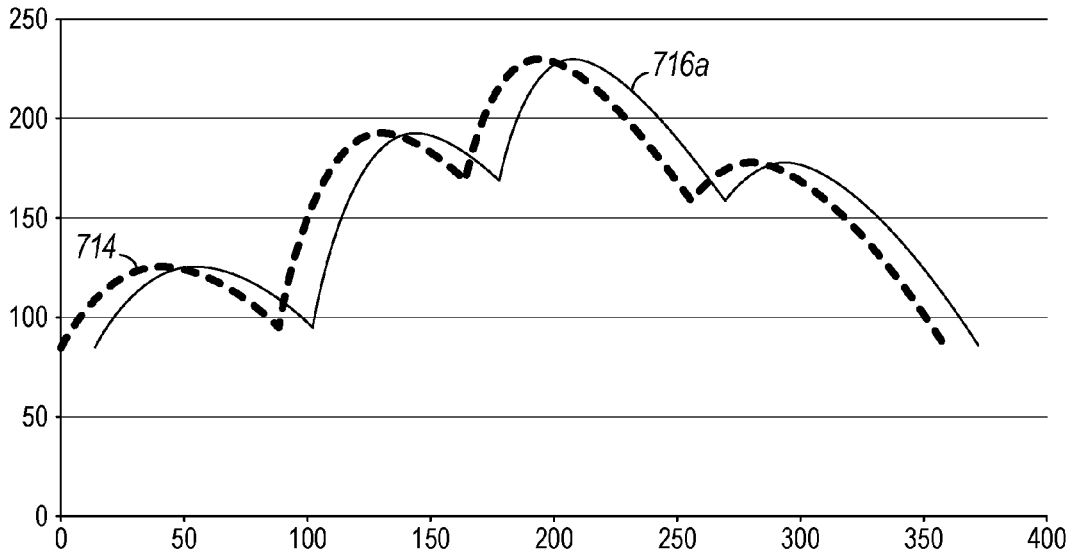
FIGS. 24A and 24B are graphs illustrating an example rotational data shift consistent with the invention.
Figure 24B:
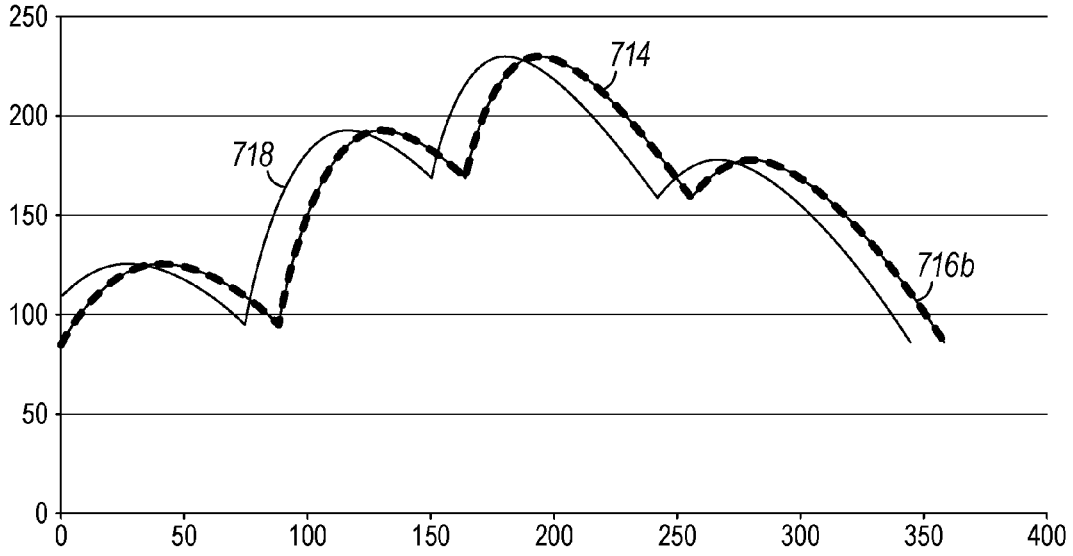

As shown in FIG. 24A, for example, a calculated wrap speed model may calculate a desired dispense rate having a profile 714, yet due to system lag, if that profile is applied to control the dispense rate of a packaging material dispenser, the actual profile 716*a* may be delayed relative to the desired profile 714. By accounting for system lag and providing a rotational shift such that the dispense rate is applied based on a dispense rate control signal having a rotationally shifted profile 718 as shown in FIG. 24B, the resulting actual profile 716*b* more closely approximates the desired profile 714.

Figure 25:
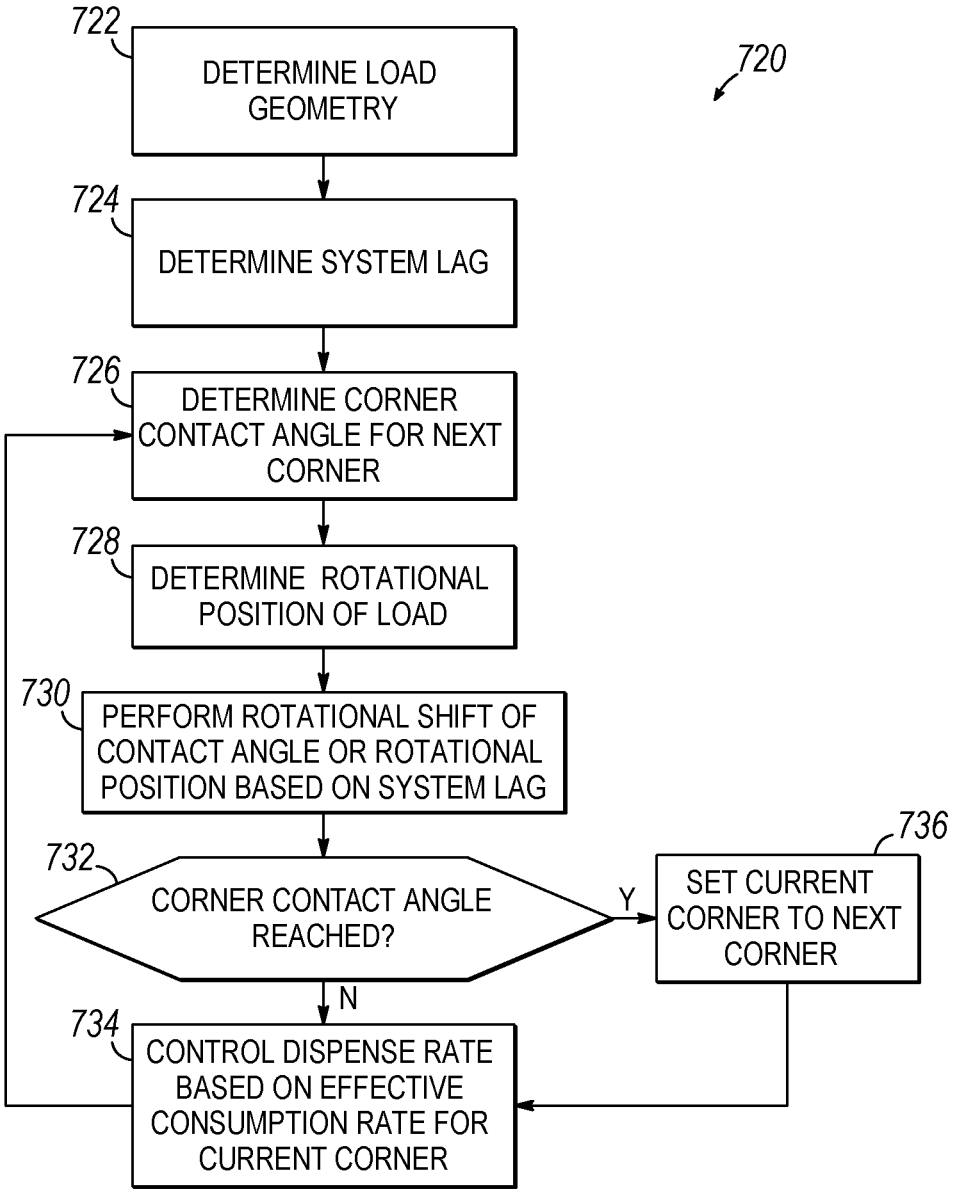
FIG. 25 is a flowchart illustrating an example sequence of steps performed by a wrapping operation implementing a rotational data shift consistent with the invention.

A rotational shift may be performed, for example, in the manner illustrated by process 720 of FIG. 25, which is similar to process 680 of FIG. 21. Process 720 may begin in block 722 by determining the geometry of the load, e.g., the dimensions, offset and/or corner locations. In one embodiment, for example, an initial revolution of the load may be performed, while in another embodiment, the dimensions of the load may be input or retrieved from a database. Alternatively, the geometry may be determined during wrapping via any of the sensed inputs discussed above.

Next, in block 724, the system lag is determined. In some embodiments, the system lag may be a fixed value, and in other embodiments, the system lag may be a variable value that may be calculated, for example, based on wrapping speed. In still other embodiments, system lag may be determined dynamically during wrapping, e.g., so that a system lag determined during one revolution is used to perform a rotational shift in one or more subsequent revolutions.

Next, process 720 proceeds by tracking the corner contact angle for a next corner in block 726, determining the current rotational position of the load in block 728 (e.g., using an angle sensor such as angle sensor 152 of FIG. 1), and then performing a rotational shift of either the corner contact angle (by subtracting from the calculated corner contact angle) or the current rotational position of the load (by adding to the sensed rotational position) to offset the system lag in block 730. Thereafter, block 732 determines whether the corner contact angle for the next corner has been reached, but in this case, the comparison incorporates the rotational shift such that the corner contact is detected earlier than would otherwise occur based on the wrap speed model.

So long as the corner contact has not yet been detected, block 732 passes control to block 734 to control the dispense rate based on the effective consumption rate calculated from the location of the current corner, and control returns to block 726. In addition, based upon the rotational shift applied in block 730, the wrap speed model is effectively advanced to offset the system lag.

Returning to block 732, if corner contact has been detected, control is passed to block 736 to set the current corner to the next corner, such that when control is passed to block 734, the next corner, now the new current corner, is used to determine the dispense rate, again with the rotational shift accounted for in the wrap speed model.

Rotational shifts may also be applied in other manners consistent with the invention. For example, through positioning of a sensor such as a load distance sensor at an earlier rotational position, e.g., shifted a few degrees in advance of a base or home position, the sensor data may be treated as if it were collected at the base or home position to apply a rotational shift to the model.

Conclusion

Embodiments of the invention may be used, for example, to increase containment force applied to a load by packaging material, and moreover, reduce fluctuations in wrap force that may occur during a wrapping operation, particularly at higher wrapping speeds. By reducing force fluctuations, the difference between the maximum applied wrap forces, which might otherwise cause packaging material breakages, and the minimum applied wrap forces, which affect the overall containment force that may be achieved, may be reduced, enabling improved containment forces to be achieved with reduced risk of breakages. In many instances, reducing the force fluctuations will permit higher containment forces to be obtained with thinner packaging material, with increased prestretch and/or with less packaging material (e.g., through the use of fewer layers). In many instances, containment forces are more consistent across all corners and sides of the load.

It is also contemplated that any sequence or combination of the above-described methods may be performed during the wrapping of one or more loads. For example, while wrapping a load, one method may be performed, whereas while wrapping another load, another method may be performed. Additionally or alternatively, while wrapping a single load, two or more of the three methods may be performed. One method may be performed during one portion of the wrapping cycle, and another method may be performed during another portion of the wrapping cycle. Additionally or alternatively, one load may be wrapped using a first combination of methods, while another load may be wrapped using a second combination of methods (e.g., a different combination of methods, and/or a different sequence of methods).

Other embodiments will be apparent to those skilled in the art from consideration of the specification and practice of the present invention. It is intended that the specification and examples be considered as exemplary only, with a true scope and spirit of the disclosure being indicated by the following claims.

What is claimed is:

1. An apparatus for wrapping a load with packaging material, the apparatus comprising:

a packaging material dispenser for dispensing packaging material to the load;

a load support for supporting the load during wrapping, wherein the packaging material dispenser and the load support are adapted for rotation relative to one other about a center of rotation;

an angle sensor that senses an angular relationship between the load and the packaging material dispenser about the center of rotation; and a controller coupled to the angle sensor and the packaging material dispenser and that calculates a location of at least one corner of the load within a plane perpendicular to the center of rotation and controls a dispense rate of the packaging material dispenser during the relative rotation using the calculated location of the at least one corner and based at least in part on a geometric relationship between the packaging material dispenser and the at least one corner of the load during the relative rotation and determined using the sensed angular relationship.

2. The apparatus of claim 1, wherein the controller controls the dispense rate of the packaging material dispenser during the relative rotation based at least in part on the geometric relationship by controlling the dispense rate of the packaging material dispenser based at least in part on a rotation angle about the center of rotation and associated with at least one corner of the load during the relative rotation, wherein the rotation angle is determined using the sensed angular relationship.

3. The apparatus of claim 2, wherein the rotation angle is a corner location angle.

4. The apparatus of claim 2, wherein the rotation angle is a corner contact angle representing an angle at which packaging material first comes into contact with the at least one corner during the relative rotation between the load and a packaging material dispenser.

5. The apparatus of claim 2, wherein the controller controls the dispense rate of the packaging material dispenser during the relative rotation based at least in part on the geometric relationship by controlling the dispense rate of the packaging material dispenser based at least in part on a corner radial for a corner of the load, wherein the corner radial has a length and extends substantially between the corner and the center of rotation.

6. The apparatus of claim 2, wherein the controller calculates the location of the at least one corner by determining a polar or Cartesian coordinate within the plane for the at least one corner of the load.

7. The apparatus of claim 6, wherein the polar or Cartesian coordinate is relative to the center of rotation.

8. The apparatus of claim 2, wherein the angle sensor comprises an encoder that senses rotation of the load support or of the packaging material dispenser about the center of rotation, and wherein the angle sensor senses the angular relationship in terms of degrees or fractions of degrees about the center of rotation.

9. The apparatus of claim 2, further comprising a film angle sensor that senses an angle of a portion of the packaging material extending between a first point proximate to where the packaging material exits the packaging material dispenser and a second point proximate to where the packaging material engages the load, and wherein the controller is determines the rotation angle using the sensed angle.

10. The apparatus of claim 2, further comprising a load distance sensor that senses a distance between a reference point and a surface of the load along a radius of the center of rotation, and wherein the controller determines the rotation angle using the sensed distance.

11. The apparatus of claim 2, further comprising a speed sensor that senses a rate at which the packaging material exits the packaging material dispenser, and wherein the controller is determines the rotation angle using the sensed rate.

12. The apparatus of claim 2, further comprising a dimensional sensor that senses a length, width and offset of the load from the center of rotation, and wherein the controller determines the rotation angle using the sensed length, width and offset.

13. The apparatus of claim 2, wherein the controller controls the dispense rate of the packaging material dispenser during the relative rotation based at least in part on the geometric relationship between the packaging material dispenser and at least one corner of the load during the relative rotation by determining a distance between the packaging material dispenser and at least one corner of the load during the relative rotation.

14. The apparatus of claim 13, wherein the controller determines the distance between the packaging material dispenser and at least one corner of the load based upon a distance between the packaging material dispenser and the center of rotation and a distance between at least one corner of the load and the center of rotation.

15. The apparatus of claim 14, wherein the controller is determines the distance between the packaging material dispenser and at least one corner of the load using the Law of Cosines.

16. The apparatus of claim 1, wherein the controller controls the dispense rate of the packaging material dispenser during the relative rotation based at least in part on the geometric relationship between the packaging material dispenser and at least one corner of the load during the relative rotation by determining an angle of a portion of the packaging material extending between the packaging material dispenser and at least one corner of the load during the relative rotation.

17. The apparatus of claim 2, wherein the rotation angle is determined by the controller after initiating relative rotation between the packaging material dispense and the load support.

18. The apparatus of claim 1, wherein the controller determines the location of the at least one corner of the load by determining a length, a width and an offset of the load from the center of rotation.

19. The apparatus of claim 18, wherein the controller determines the length, width and offset based upon user input.

20. The apparatus of claim 18, wherein the controller determines the length, width and offset using at least one sensor.

21. The apparatus of claim 18, wherein the controller retrieves the length, width and offset from a database.

22. The apparatus of claim 17, wherein the rotation angle is determined by the controller during relative rotation between the packaging material dispenser and the load support.

23. The apparatus of claim 1, wherein the controller controls the dispense rate of the packaging material dispenser during the relative rotation based at least in part on the geometric relationship between the packaging material dispenser and at least one corner of the load during the relative rotation by controlling a dispense rate of the packaging material dispenser to be proportional to a rate of change of a corner of the load relative to the packaging material dispenser.

24. The apparatus of claim 23, wherein the rate of change of the corner is associated with a tangential velocity of a tangent circle centered at the center of rotation and tangent to a portion of the packaging material extending between the packaging material dispenser and the corner.

25. The apparatus of claim 1, wherein the controller controls the dispense rate of the packaging material dispenser during the relative rotation based at least in part on the geometric relationship between the packaging material dispenser and at least one corner of the load during the relative rotation by determining an effective consumption rate of the load over an interval.

26. The apparatus of claim 25, wherein the controller determines the effective consumption rate of the load over the interval by determining a length of packaging material consumed over the interval.

27. The apparatus of claim 25, wherein the controller controls the dispense rate of the packaging material dispenser to dispense a controlled length of packaging material over a portion of the relative rotation.

28. A method of wrapping a load with packaging material, the method comprising:

providing relative rotation between a load support and a packaging material dispenser about a center of rotation to dispense packaging material to the load;

sensing with an angle sensor an angular relationship between the load and the packaging material dispenser about the center of rotation;

sensing the load with a dimensional sensor and determining therefrom a length, a width and an offset of the load from the center of rotation; and controlling a dispense rate of the packaging material dispenser during the relative rotation based at least in part on a geometric relationship between the packaging material dispenser and at least one corner of the load during the relative rotation and determined using the sensed angular relationship and the determined length, width and offset.

29. An apparatus for wrapping a load with packaging material using a packaging material dispenser adapted for relative rotation with a load support for the load about a center of rotation, comprising:

an angle sensor that senses an angular relationship between the load and the packaging material dispenser about the center of rotation;

a dimensional sensor that senses the load;

a controller coupled to the angle sensor, the dimensional sensor and the packaging material dispenser; and program code initiated upon execution by the controller to determine a length, a width and an offset of the load from the center of rotation using the dimensional sensor and control a dispense rate of the packaging material dispenser during the relative rotation based at least in part on a geometric relationship between the packaging material dispenser and at least one corner of the load during the relative rotation and determined using the sensed angular relationship and the determined length, width and offset.

30. A method of wrapping a load with packaging material, the method comprising:

providing relative rotation between a load support and a packaging material dispenser about a center of rotation to dispense packaging material to the load;

sensing with an angle sensor an angular relationship between the load and the packaging material dispenser about the center of rotation;

calculating locations of both a current corner and a next corner of the load within a plane perpendicular to the center of rotation;

controlling a dispense rate of the packaging material dispenser based at least in part on a geometric relationship between the packaging material dispenser and the current corner of the load to which the packaging material is currently engaging during the relative rotation and determined using the sensed angular relationship and the calculated location of the current corner;

determining when the packaging material will engage a next corner of the load using the sensed angular relationship; and controlling the dispense rate based at least in part on a geometric relationship between the packaging material dispenser and the next corner of the load after the packaging material engages the next corner of the load and determined using the sensed angular relationship and the calculated location of the next corner.

31. The method of claim 30, further comprising tracking a rotation angle associated with the current corner of the load during the relative rotation, wherein controlling the dispense rate based at least in part on the geometric relationship between the packaging material dispenser and the current corner of the load includes controlling the dispense rate based at least in part on a rotation angle about the center of rotation and associated with the current corner, wherein the rotation angle is determined using the sensed angular relationship.

32. The method of claim 31, further comprising tracking a rotation angle associated with the next corner of the load during the relative rotation, wherein determining when the packaging material will engage the next corner of the load includes detecting contact between the packaging material and the next corner while controlling the dispense rate based at least in part on the tracked rotation angle associated with the current corner, and wherein controlling the dispense rate based at least in part on the geometric relationship between the packaging material dispenser and the next corner of the load includes controlling the dispense rate based at least in part on the rotation angle associated with the next corner.

33. The method of claim 30, wherein determining when the packaging material will engage a next corner of the load includes detecting a local minimum of a film angle sensor.

34. The method of claim 30, wherein determining when the packaging material will engage a next corner of the load includes detecting a local minimum of a load distance sensor.

35. The method of claim 30, wherein determining when the packaging material will engage a next corner of the load includes determining when an effective consumption rate calculated for the next corner becomes larger than an effective consumption rate calculated for the current corner.

36. The method of claim 30, wherein determining when the packaging material will engage a next corner of the load is based on an effective consumption rate calculated for the next corner or an effective consumption rate calculated for the current corner.

37. The method of claim 30, wherein determining when the packaging material will engage a next corner of the load includes determining a contact angle based upon dimensions of the load.

38. The method of claim 30, wherein determining when the packaging material will engage a next corner of the load includes determining a contact angle where the next corner intersects a plane extending between the current corner and the packaging material dispenser.

39. An apparatus for wrapping a load with packaging material, the apparatus comprising:

a packaging material dispenser for dispensing packaging material to the load;

a load support for supporting the load during wrapping, wherein the packaging material dispenser and the load support are adapted for rotation relative to one other about a center of rotation;

an angle sensor that senses an angular relationship between the load and the packaging material dispenser about the center of rotation; and a controller coupled to the angle sensor and that calculates a location of each of a current corner of the load and a next corner of the load within a plane perpendicular to the center of rotation and controls a dispense rate of the packaging material dispenser using the calculated location of the current corner and based at least in part on a geometric relationship between the packaging material dispenser and the current corner of the load to which the packaging material is currently engaging during the relative rotation and determined using the sensed angular relationship, determines when the packaging material will engage the next corner of the load using the sensed angular relationship, and controls the dispense rate using the calculated location of the next corner and based at least in part on a geometric relationship between the packaging material dispenser and the next corner of the load after the packaging material engages the next corner of the load and determined using the sensed angular relationship.

40. The apparatus of claim 39, wherein the controller initiates a controlled intervention in response to determining when the packaging material will engage a next corner of the load.

41. The apparatus of claim 40, wherein the controlled intervention decreases the dispensing rate below a predicted demand immediately in advance of contact between the packaging material and the corner during the relative rotation to increase a wrap force captured by the corner.

42. The apparatus of claim 40, wherein the controlled intervention increases the dispensing rate above a predicted demand immediately subsequent to contact between the packaging material and the corner during the relative rotation to reduce a wrap force incurred by the corner.

43. The apparatus of claim 40, wherein the controlled intervention decreases the dispensing rate below a predicted demand proximate contact between the packaging material and the corner during the relative rotation to produce a force spike in the packaging material proximate the contact.

44. The apparatus of claim 39, wherein the controller compensates for system lag by rotationally shifting collected data in response to determining when the packaging material will engage a next corner of the load.

* * * * *